US009770727B2

(12) United States Patent
Yamada

(10) Patent No.: US 9,770,727 B2
(45) Date of Patent: Sep. 26, 2017

(54) ELECTROSTATIC COATING APPARATUS

(71) Applicant: ABB K.K., Shibuya-ku (JP)

(72) Inventor: Yukio Yamada, Fujieda (JP)

(73) Assignee: ABB K.K., Shinagawa-ku (JP)

( * ) Notice: Subject to any disclaimer, the term of this patent is extended or adjusted under 35 U.S.C. 154(b) by 386 days.

(21) Appl. No.: 14/608,681

(22) Filed: Jan. 29, 2015

(65) Prior Publication Data

US 2015/0182979 A1 Jul. 2, 2015

Related U.S. Application Data

(62) Division of application No. 13/145,949, filed as application No. PCT/JP2010/056512 on Apr. 12, 2010, now Pat. No. 8,978,580.

(30) Foreign Application Priority Data

May 11, 2009 (JP) ..... 2009-114624

(51) Int. Cl.
*B05B 5/053* (2006.01)
*B05B 5/04* (2006.01)
(Continued)

(52) U.S. Cl.
CPC ..... *B05B 5/0535* (2013.01); *B05B 5/0403* (2013.01); *B05B 5/0407* (2013.01);
(Continued)

(58) Field of Classification Search
CPC .... B05B 5/0407; B05B 5/0426; B05B 5/0533
See application file for complete search history.

(56) References Cited

U.S. PATENT DOCUMENTS 4,572,437 A * 2/1986 Huber ..... B05B 5/0407 239/214.11
5,775,598 A * 7/1998 Takayama ..... B05B 5/0533 239/703
(Continued)

FOREIGN PATENT DOCUMENTS

JP 58-92475 A 6/1983
JP S5892475 A * 6/1983
(Continued)

OTHER PUBLICATIONS

International Search Report issued Jul. 20, 2010 in PCT/JP10/056512 filed Apr. 12, 2010.
(Continued)

*Primary Examiner* — Dah-Wei D Yuan
*Assistant Examiner* — Stephen Kitt
(74) *Attorney, Agent, or Firm* — Oblon, McClelland, Maier & Neustadt, L.L.P.

(57) ABSTRACT

A rotary atomizing head (4) is mounted on a fore end side of a motor (3). A shaping air ring (9) having a plurality of air outlet holes (10) at fixed intervals is provided on a rear side of the rotary atomizing head (4). Outer surfaces of the air motor (3) and outer surfaces of the shaping air ring (9) are enshrouded over the entire circumference by a cover member (7) formed of an electrically insulating material. An external electrode assembly (13) is provided radially outwardly of the cover member (7). An annular projecting portion (16) which projects forward is provided on the shaping air ring (9) over the entire circumference. The air outlet holes (10) are open in a fore distal end of this annular projecting portion (16). As a result, a corona discharge can be generated by allowing an electric field to be concentrated at the fore distal end of the annular protecting portion (16).

4 Claims, 27 Drawing Sheets

(51) Int. Cl.

| | |
|---|---|
| ***B05B 5/057*** | (2006.01) |
| *B05B 3/10* | (2006.01) |
| *B05B 15/02* | (2006.01) |

(52) U.S. Cl.

CPC ..... *B05B 5/0426* (2013.01); *B05B 5/057* (2013.01); *B05B 5/0533* (2013.01); *B05B 3/1064* (2013.01); *B05B 15/02* (2013.01)

(56) References Cited

U.S. PATENT DOCUMENTS

| | | | |
|---|---|---|---|
| 7,546,962 | B2 | 6/2009 | Yamada |
| 7,661,610 | B2 | 2/2010 | Yamada |
| 2010/0206225 | A1 | 8/2010 | Yamada |

FOREIGN PATENT DOCUMENTS

| | | | | |
|---|---|---|---|---|
| JP | 62 118545 | | | 7/1987 |
| JP | 2-91656 | U | | 7/1990 |
| JP | H0291656 | U | * | 7/1990 |
| JP | 8 332418 | | | 12/1996 |
| JP | 08332418 | A | | 12/1996 |
| JP | 9-94488 | A | | 4/1997 |
| JP | H0994488 | A | * | 4/1997 |
| JP | 11 276937 | | | 10/1999 |
| JP | H11276837 | A | * | 10/1999 |
| JP | 2001 113207 | | | 4/2001 |

OTHER PUBLICATIONS

Extended European Search Report issued Jan. 9, 2014 in Patent Application No. 10774799.0.
U.S. Appl. No. 14/608,580, filed Jan. 29, 2015, Yamada.

* cited by examiner

ELECTROSTATIC COATING APPARATUS

CROSS-REFERENCE TO RELATED APPLICATIONS

This application is a divisional of and claims the benefit of priority under 35 U.S. C. §120 from U.S. application Ser. No. 13/145,949, filed Jul. 22, 2011, which is a National Stage of PCT Application No. PCT/JP10/056512, filed Apr. 12, 2010, and claims the benefit of priority under 35 U.S.C. §119 of Japanese Application No. 2009-114624, filed May 11, 2009; the entire contents of each of which are incorporated herein by reference.

TECHNICAL FIELD

This invention relates to an electrostatic coating apparatus which is adapted to spray paint under application of a high voltage.

BACKGROUND ART

Generally, there has been known an electrostatic coating apparatus which includes, for example, a rotary atomizing head provided on a fore end side of an air motor, a cover member provided in a tubular shape in such a manner as to enshroud outer surfaces of the air motor formed of an electrically insulating material, and a high voltage generator for charging paint particles, which are sprayed by the rotary atomizing head of an atomizer, with a negative high voltage by means of an external electrode assembly (e.g., Patent Document 1: Japanese Patent Laid-Open No. 2001-113207 A, and Patent Document 2: Japanese Patent Laid-Open No. Hei 11-276937 A).

In the electrostatic coating apparatuses described in Patent Documents 1 and 2, a shaping air ring having a plurality of air outlet holes is provided on the rear side of the rotary atomizing head. The air outlet holes of this shaping air ring spurt out shaping air toward a vicinity of a paint releasing edge of the rotary atomizing head. Consequently, the shaping air shears and atomizes the liquid thread of the paint released from the rotary atomizing head, and shapes the spraying pattern of this atomized paint.

With the electrostatic coating apparatus according to the conventional art, electrostatic fields are formed by electric flux lines between the external electrode assembly with the negative high voltage applied thereto and the rotary atomizing head held at earth potential and between the external electrode assembly and a work piece, respectively. In the vicinity of a fore distal end of the external electrode assembly, corona ions are generated by a corona discharge, and a negative ionization zone is formed by these corona ions.

If, in this state, paint is sprayed by the rotary atomizing head which is put in high speed rotation, paint particles sprayed from the rotary atomizing head are electrified by application of a negative high voltage during travel through the ionization zone to become negatively charged paint particles. As a result, the charged paint particles are urged to fly toward the work piece and deposit on surfaces of the work piece which is connected to the earth.

In addition, as an electrostatic coating apparatus according to another conventional art, a construction is known in which a negative high voltage is applied to a rotary atomizing head formed of a metallic material, and paint is directly electrified with a high voltage through the rotary atomizing head (e.g., Patent Document 3: Japanese Utility Model Laid-Open No. Sho 62-118545 U).

In the electrostatic coating apparatus described in Patent Document 3, an end plate serving as a shaping air ring is provided on the rear side of the rotary atomizing head, and a corona pin is provided on the front surface of the end plate in such a manner as to be located on the radially inwardly of air outlet holes and extend toward a rear surface of the rotary atomizing head. As a negative high voltage is applied to this corona pin, corona ions are supplied to the rear surface side of the rotary atomizing head. Paint particles which approached the rear surface side of the rotary atomizing head are negatively charged by the corona ions. As a result, since the rotary atomizing head and the paint particles which are of the same negative polarity repel from each other, it is possible to prevent the deposition of the paint particles on the rear surface of the rotary atomizing head.

SUMMARY OF THE INVENTION

In the case of the electrostatic coating apparatus according to Patent Document 1, the outer surface of the cover member is electrified to negative polarity by discharged negative ions. Therefore, repulsion takes place between the cover member and paint particles which are electrified to the same negative polarity, preventing the paint particles from depositing on the outer surface of the cover member. The cover member and the like which are formed of electrically insulating materials prevent high voltage electrostatic charges on their outer surfaces from leaking to the side of the earth potential.

However, although the paint is negatively electrified in the process of its atomization, there occurs a phenomenon in which paint particles which are electrified to opposite polarity are also formed by induction charging. More specifically, the charged paint particles placed in the electric field polarize owing to electrostatic induction. At this time, electrons in the paint particles move such that the internal electric field in the paint particles becomes zero (0) by offsetting the effect of the external electric field. For this reason, in the paint particles, electrons are offset toward the external electrode assembly side, while electrons become lacking on the earth side such as the rotary atomizing head and the like, and holes come to increase. When the polarized paint particles are dynamically separated into two by shaping air, the state becomes such that electrons are excessive on one side, and electrons are lacking on the other side. As a result, the paint particles which lack electrons are electrified positively.

These positively charged paint particles are attracted toward and deposit on the negatively charged cover member. Since this deposited paint causes the degree of electrical insulation of the outer surface of the cover member to decline, the deposition of the paint on the cover member progresses rapidly. For this reason, with the conventional art, it has been compelled to frequently interrupt the coating operation in order to remove the deposited paint.

Meanwhile, Patent Document 2 discloses a construction in which the rotary atomizing head is formed of an electrically insulating synthetic resin material, and an electrically conducting film is provided on the rear surface side of the rotary atomizing head. In the invention of Patent Document 2, acicular external electrode members are caused to project from air outlet holes, and the electrically conducting film is negatively electrified by using these external electrode members. However, in a case where the metallic rotary atomizing head is connected to the earth, the distance between the earth and the external electrode members is too close, so that spark discharges tend to be generated between the external electrode members and the rotary atomizing head. In addition, since the external electrode members are disposed forwardly of the shaping air ring, corona ions cannot be supplied to the cover member. For this reason, the cover member cannot be negatively electrified, so that there is another problem in that the deposition of the paint cannot be prevented by the use of electrical repulsion.

Further, Patent Document 3 discloses a construction in which a corona pin is provided by being located radially inwardly of air out holes, and corona ions are supplied to the rear surface side of the rotary atomizing head by using the corona pin. In this construction, the paint particles which approached the rear surface side of the rotary atomizing head can be negatively electrified by negative ions. However, since corona ions cannot be supplied to the paint particles which are distant from the rotary atomizing head, there is a problem in that the paint particles deposit on the negatively charged housing when the positively charged paint particles moved to around the housing.

In view of the above-discussed problems with the conventional art, it is an object of the present invention to provide an electrostatic coating apparatus which is capable of preventing deposition of paint on the cover member.

(1) The present invention is applied to an electrostatic coating apparatus constructed of a motor, a rotary atomizing head provided rotatably on a fore end side of the motor, a shaping air ring disposed on a rear side of the rotary atomizing head, a plurality of air outlet holes provided in the shaping air ring and arranged in an annular shape along a paint releasing edge of the rotary atomizing head to spurt out shaping air, a cover member provided in a tubular shape in such a manner as to enshroud outer surfaces of the motor, an external electrode assembly provided radially outwardly of an outer periphery of the cover member, and a high voltage application means for applying a high voltage to the external electrode assembly to indirectly electrify sprayed paint particles from the rotary atomizing head with a high voltage electrostatic charge.

In order to overcome the above-discussed problems, the characteristic feature of the construction adopted in the present invention lies in that: the rotary atomizing head is formed of a material which is electrically conductive in its entirety or whose surface at least is electrically conductive or semi-conductive and the rotary atomizing head is connected to the earth; the shaping air ring is formed of an electrically conducting material, and is connected to the earth; the cover member is formed of an electrically insulating material, and is arranged to enshroud an outer peripheral side of the shaping air ring over its entire surface; and an electric field concentrating portion for causing an electric field to be concentrated around the air outlet holes is provided on the shaping air ring.

According to the present invention, in the vicinity of the external electrode assembly, corona ions are generated by a corona discharge, and a negative ionization zone is formed by these corona ions. For this reason, paint particles sprayed from the rotary atomizing head, upon traveling through the ionization zone, are electrified with a negative high voltage electrostatic charge to become charged paint particles.

Meanwhile, since the rotary atomizing head and the shaping air ring are connected to the earth, a discharge is likely to occur around the rotary atomizing head and the shaping air ring due to the high voltage applied to the external electrode assembly. On the other hand, since the cover member enshrouds not only the entire outer surfaces of the motor but also the outer surfaces of the shaping air ring over the entire circumference, the discharge is not generated on the outer peripheral side of the motor and the shaping air ring.

Here, since the electric field concentrating portion is formed on the shaping air ring, a secondary corona discharge can be generated by allowing an electric field to be concentrated around the air outlet holes by the electric field concentrating portion. As a result, corona ions are generated around the air outlet holes, so that corona ions, together with the shaping air, can be supplied to the paint particles immediately after being released from the rotary atomizing head.

When the paint particles are sprayed from the rotary atomizing head, or when the paint particles are severed by the shaping air, there are cases where paint particles of opposite polarity or paint particles which lost charges are generated. Even in such a case, corona ions are generated in the vicinities of the air outlet holes, and these paint particles can be reliably electrified negatively by supplying the corona ions thereto. In consequence, since all the paint particles repel from the negatively charged cover member, it is possible to prevent deposition of paint on the cover member.

Further, since the amount of charges in the paint particles can be increased, it is possible to augment the Coulomb force acting between the paint particles and the work piece. As a result, it is possible to enhance the deposition efficiency of the paint on the work piece.

(2) In the present invention, the electric field concentrating portion may be arranged to be provided over an entire circumference of the shaping air ring along the plurality of air outlet holes.

By this arrangement, the corona discharge can be generated uniformly over the entire circumference of the shaping air ring. For this reason, when the shaping air is spurted out toward the paint releasing edge of the rotary atomizing head, corona ions can be supplied over the entire circumference of the paint releasing edge by the shaping air, so that all the paint particles sprayed from the paint releasing edge can be reliably electrified negatively.

(3) In the present invention, the electric field concentrating portion may be adapted to enhance the electric field strength to 5 kV/mm or higher.

By this arrangement, the electric field strength at the electric field concentrating portion can be made higher than a minimum electric field strength which allows the corona discharge to be generated. In consequence, the corona discharge can be maintained stably by the electric field concentrating portion.

(4) In the present invention, a fore distal end of the external electrode assembly may be disposed rearwardly of the air outlet holes, and a distance dimension between the fore distal end of the external electrode assembly and the electric field concentrating portion may be arranged to be set to a value shorter than a distance dimension between the fore distal end of the external electrode assembly and the paint releasing edge of the rotary atomizing head.

By this arrangement, the electric field strength at the electric field concentrating portion can be made higher than at the paint releasing edge of the rotary atomizing head. In consequence, it is possible to suppress the electric field from being concentrated at the paint releasing edge of the rotary atomizing head, thereby making it possible to reliably generate the corona discharge at the electric field concentrating portion.

(5) In the present invention, the electric field concentrating portion may be formed by an annular projecting portion which is formed in an annular shape along the plurality of air outlet holes formed in a front side portion of the shaping air ring, and projects from the front side portion of the shaping air ring toward the rotary atomizing head, and the plurality of air outlet holes may be arranged to be open at a fore distal end of the annular projecting portion.

By this arrangement, the corona discharge can be generated by allowing the electric field to be concentrated at the fore distal end portion of the annular projecting portion. In addition, since the plurality of air outlet holes are open at the fore distal end of the annular projecting portion, corona ions which are generated in the vicinity of the fore distal end of the annular projecting portion can be supplied toward the paint releasing edge of the rotary atomizing head by the shaping air which is spurted out from the air outlet holes.

(6) In the present invention, the electric field concentrating portion may be formed by an annular blade projecting portion which is formed in an annular shape along the plurality of air outlet holes formed in a front side portion of the shaping air ring, and projects from the front side portion of the shaping air ring toward the rotary atomizing head, the annular blade projecting portion is formed as an edge portion in the form of a thin blade over an entire circumference of a fore distal end, and the plurality of air outlet holes may be arranged to be open at positions recessed from the fore distal end of the annular blade projecting portion.

By this arrangement, the corona discharge can be generated by allowing the electric field to be concentrated at the edge portion of the annular blade projecting portion which is formed in fashion of a thin blade. Since the plurality of air outlet holes are open at positions recessed from the fore distal end of the annular blade projecting portion, corona ions which are generated in the peripheries of the edge portion of the annular blade projecting portion can be supplied toward the paint releasing edge of the rotary atomizing head by the shaping air which is spurted out from the air outlet holes.

(7) In the present invention, the electric field concentrating portion may be formed by a plurality of tubular projecting portions which surround each of open ends of the plurality of air outlet holes formed in a front side portion of the shaping air ring, and each of the tubular projecting portions may project from the front end portion of the shaping air ring toward the rotary atomizing head.

By this arrangement, the corona discharge can be generated by allowing the electric field to be concentrated at the fore distal end portions of the tubular projecting portions. Since the tubular projecting portions surround the open ends of the air outlet holes, corona ions which are generated in the vicinities of the fore distal ends of the tubular projecting portions can be supplied toward the paint releasing edge of the rotary atomizing head by the shaping air which is spurted out from the air outlet holes.

(8) In the present invention, the electric field concentrating portion may be formed by a plurality of acicular projecting portions which are arranged in an annular shape along the plurality of air outlet holes formed in a front side portion of the shaping air ring, each of the acicular projecting portions may project from the front side portion of the shaping air ring toward the rotary atomizing head, with a fore distal end thereof being arranged to be pointed in fashion of a needle.

By this arrangement, the corona discharge can be generated by allowing the electric field to be concentrated at the fore distal end portion of the acicular projecting portions. Further, since the plurality of acicular projecting portions are arranged in a circular shape along the plurality of air outlet holes, corona ions which are generated in the vicinities of the fore distal ends of the acicular projecting portions can be supplied toward the paint releasing edge of the rotary atomizing head by the shaping air which is spurted out from the air outlet holes.

(9) In the present invention, the electric field concentrating portion may be formed by an annular triangular projecting portion which are formed in an annular shape along the plurality of air outlet holes formed in a front side portion of the shaping air ring, the annular triangular projecting portion may have a triangular shape in cross section, and projects from the front end portion of the shaping air ring toward the rotary atomizing head, and a fore distal end thereof may be formed as a sharp edge portion over an entire circumference, and the plurality of air outlet holes may be arranged to be open at the edge portion of the annular triangular projecting portion.

By this arrangement, the corona discharge can be generated by allowing the electric field to be concentrated at the edge portion of the annular triangular projecting portion. Since the plurality of air outlet holes are open at the edge portion of the annular triangular projecting portion, corona ions which are generated in the peripheries of the edge portion of the annular triangular projecting portion can be supplied toward the paint releasing edge of the rotary atomizing head by the shaping air which is spurted out from the air outlet holes.

(10) In the present invention, the electric field concentrating portion may be formed by an annular projecting portion which is formed in an annular shape along the plurality of air outlet holes formed in a front side portion of the shaping air ring, the annular projecting portion may project from the front side portion of the shaping air ring toward the rotary atomizing head, the annular projecting portion may have a fore distal end surface located at a projecting end thereof, an inclined outer peripheral surface which is located on an outer peripheral side of the fore distal end surface and is inclined radially outward, and an outer peripheral edge portion which is formed between the fore distal end surface and the inclined outer peripheral surface, and the plurality of air outlet holes may be arranged to be open at the outer peripheral edge portion of the annular projecting portion.

According this arrangement, the corona discharge can be generated by allowing the electric field to be concentrated at the outer peripheral edge portion of the annular projecting portion. Since the plurality of air outlet holes are open at the outer peripheral edge portion of the annular projecting portion, corona ions which are generated in the peripheries of the outer peripheral edge portion of the annular projecting portion can be supplied toward the paint releasing edge of the rotary atomizing head by the shaping air which is spurted out from the air outlet holes.

(11) In the present invention, the electric field concentrating portion may be formed by a plurality of acute angle opening portions which are formed at each of open ends of the plurality of air outlet holes formed in a front side portion of the shaping air ring, and in which a cross section of an opening of each of the air outlet holes is formed into an acute angle.

By this arrangement, the corona discharge can be generated by allowing the electric field to be concentrated at the acute angle opening portions each obtained by forming the cross section of the opening of each of the air outlet holes into an acute angle. Since the acute angle opening portions are formed at the open ends of the air outlet holes, corona ions which are generated in the peripheries of the fore distal ends of the acute angle opening portions can be supplied toward the paint releasing edge of the rotary atomizing head by the shaping air which is spurted out from the air outlet holes.

MODE FOR CARRYING OUT THE INVENTION

Figure 1:
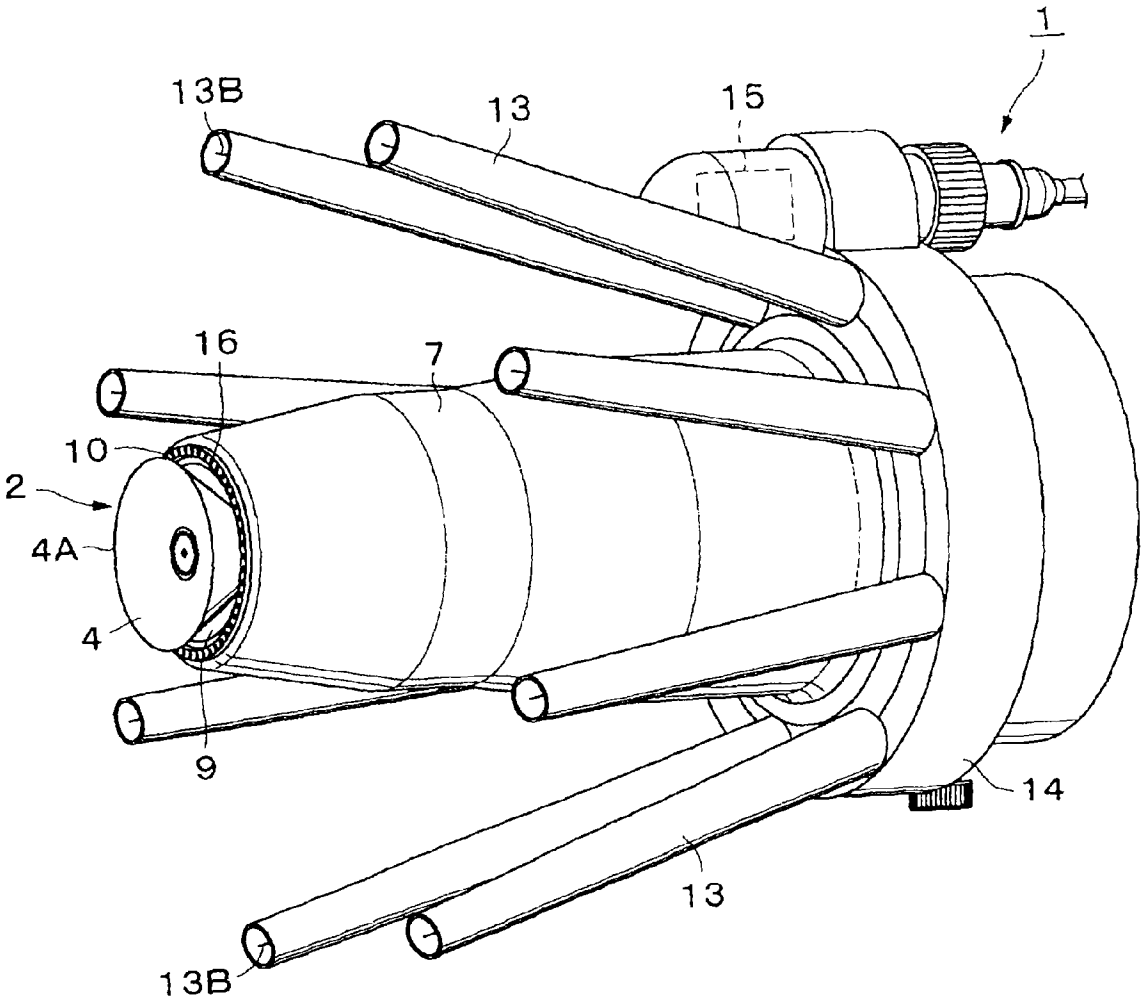
FIG. 1 is a perspective view illustrating a rotary atomizing head type coating apparatus in accordance with a first embodiment of the present invention.

Hereinafter, an electrostatic coating apparatus according to an embodiment of the present invention will be explained in greater detail with reference to the accompanying drawings, by citing as an example a rotary atomizing head type apparatus.

FIGS. 1 to 6 show a first embodiment of the electrostatic coating apparatus in according with the present invention.

In the drawings, designated at 1 is a rotary atomizing head type coating apparatus (hereinafter referred to as the coating apparatus 1) in accordance with the first embodiment. This coating apparatus 1 is comprised of an atomizer 2, a housing member 6, a cover member 7, a shaping air ring 9, an external electrode assembly 13, a high voltage generator 15, and the like, which will be described hereinafter.

Denoted at 2 is the atomizer serving as a paint spraying means for spraying paint toward a work piece which is held at the earth potential. This atomizer 2 is constituted by an air motor 3, a rotary atomizing head 4, and the like which will be described hereinafter.

Figure 2:
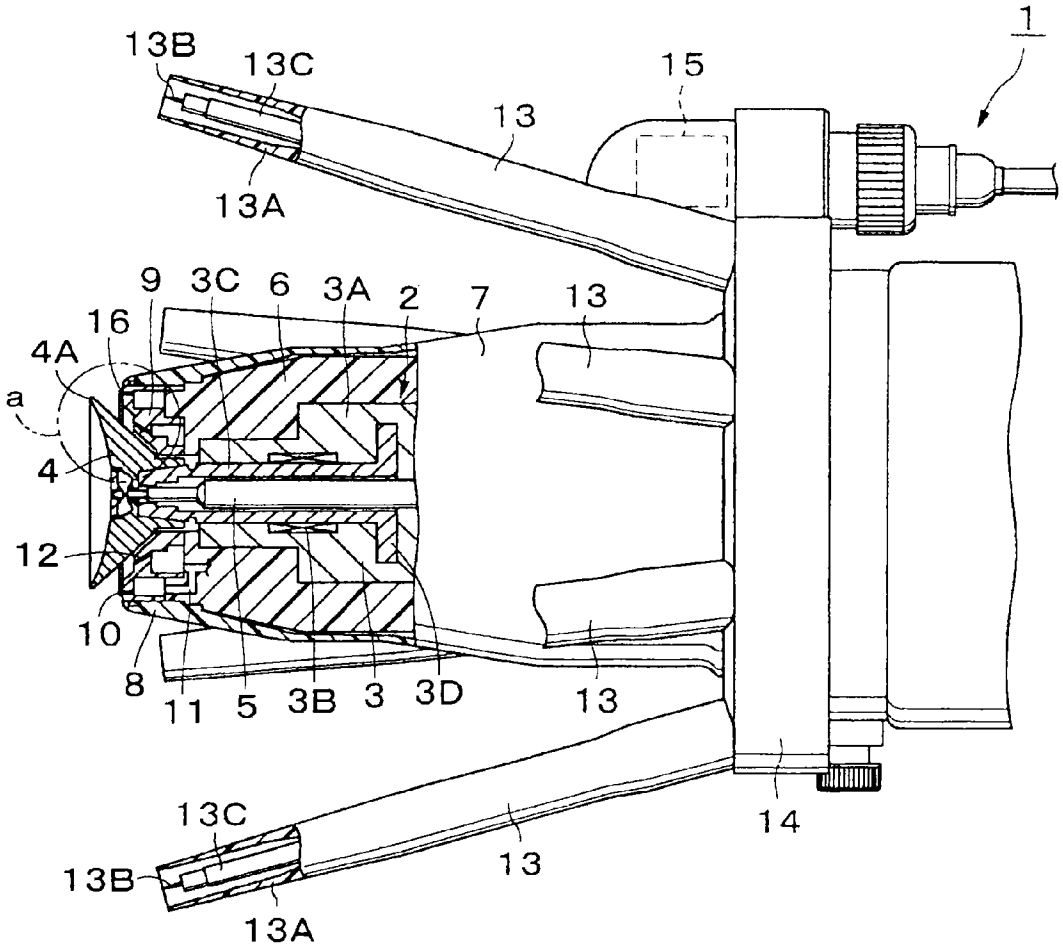
FIG. 2 is a front elevational view illustrating the rotary atomizing head type coating apparatus, which is partially cut away, shown in FIG. 1.
Figure 3:
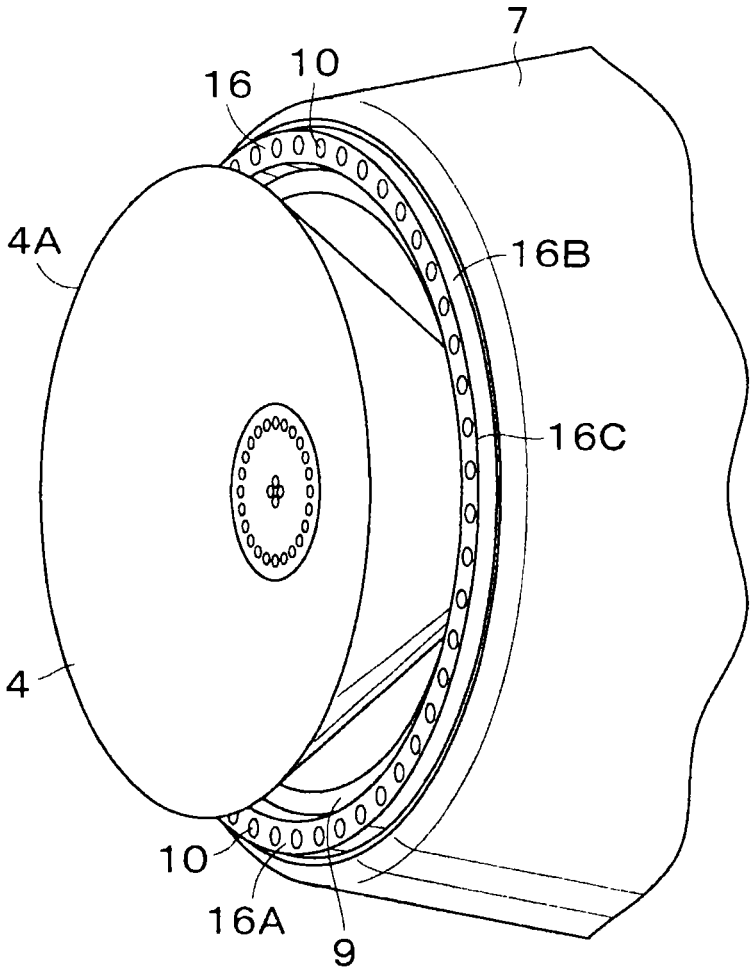
FIG. 3 is a perspective view illustrating in enlarged form a shaping air ring and the like shown in FIG. 1.

Indicated at 3 is an air motor serving as a motor for rotatively driving the rotary atomizing head 4. This air motor 3 is formed of a conducting metallic material such as an aluminum alloy, and is connected to the earth. As shown in FIG. 2, the air motor 3 is constituted by a motor housing 3A, a hollow rotational shaft 3C which is rotatably supported within the motor housing 3A through a static air bearing 3B, and an air turbine 3D which is fixed on a proximal end side of the rotational shaft 3C. As drive air is supplied to the air turbine 3D, the rotational shaft 3C of the air motor 3 is rotated at a high speed of, for example, 3,000 to 150,000 r.p.m. together with the rotary atomizing head 4.

Indicated at 4 is the rotary atomizing head which is mounted on a fore end side of the rotational shaft 3C of the air motor 3. This rotary atomizing head 4 is formed of a conducting metallic material such as an aluminum alloy, and is connected to the earth through the air motor 3. The rotary atomizing head 4 has a paint releasing edge 4A formed by being located at a distal end portion on its outer peripheral side to release the paint. The rotary atomizing head 4 is rotated at high speed by the air motor 3. In this state, when the paint is supplied to the rotary atomizing head 4 through a below-described feed tube 5, the rotary atomizing head 4 sprays the paint from the paint releasing edge 4A under the influence of a centrifugal force.

Indicated at 5 is the feed tube provided by being inserted in the rotational shaft 3C. The fore end side of the feed tube 5 projects from a distal end of the rotational shaft 3C and extends into the rotary atomizing head 4. A paint passage (not shown) is provided in the feed tube 5, and the paint passage is connected to a paint supply source and a cleaning thinner supply source (neither are shown) through a color changing valve device and the like. As a result, at the time of coating, the feed tube 5 supplies the paint from the paint supply source toward the rotary atomizing head 4 through the paint passage, and, at the time of such as cleaning and color change, supplies a cleaning fluid (thinner, air, etc.) from the cleaning thinner supply source.

Figure 6:
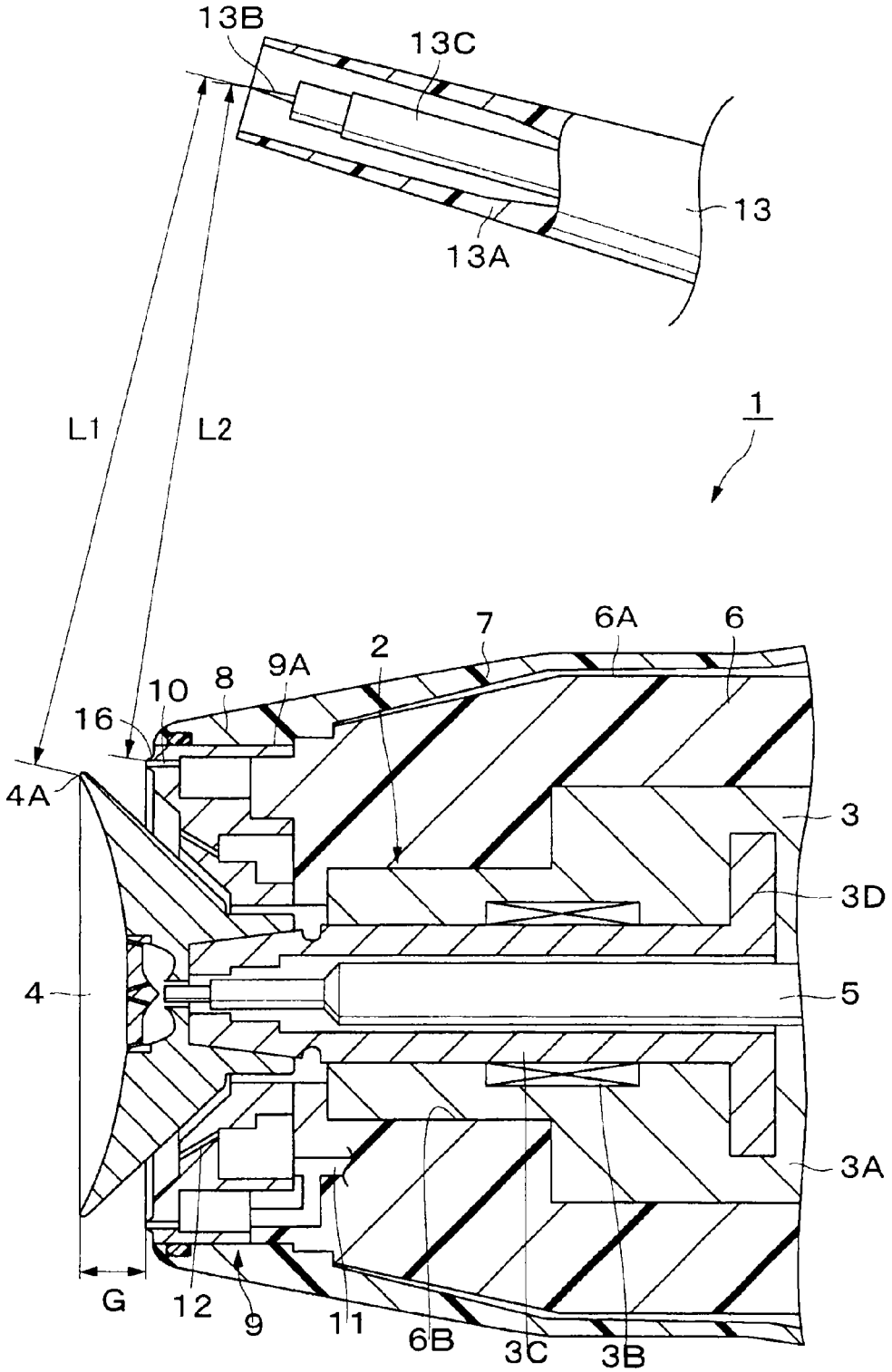
FIG. 6 is an explanatory diagram illustrating a positional relationship among a rotary atomizing head, a shaping air ring and an external electrode assembly in FIG. 2.

Indicated at 6 is the housing member in which the air motor 3 is accommodated, and the rotary atomizing head 4 is disposed on the fore end side thereof. This housing member 6 is formed in a cylindrical shape by using an electrically insulating synthetic resin material such as POM (polyoxymethylene), PET (polyethylene terephthalate), PEN (polyethylene naphthalate), PP (polypropylene), HP-PE (high pressure polyethylene), HP-PVC (high pressure polyvinyl chloride), PEI (polyether imide), PES (polyether sulfone), or polymethyl pentene. As shown in FIG. 6, the housing member 6 has a cylindrical outer peripheral surface 6A, and an air motor receptacle hole 6B for accommodating the air motor 3 is formed in a front side of the housing member 6.

Denoted at 7 is the cover member which is provided in such a manner as to enshroud the outer peripheral surface 6A of the housing member 6. This cover member 7 is formed in a tubular shape by using an electrically insulating resin material similar to such as that of the housing member 6. In addition, a ring mounting portion 8, which is attached to the below-described shaping air ring 9, is formed on the fore end side of the cover member 7. Further, the cover member 7 covers the entire outer peripheral side of the air motor 3 through the housing member 6, and covers an outer peripheral surface 9A of the shaping air ring 9 over its entire circumference by means of the ring mounting portion 8.

The cover member 7 is negatively electrified as corona ions are supplied from the below-described external electrode assembly 13. Meanwhile, the cover member 7 is formed as a seamless continuous tubular body. In addition, the outer surface of the cover member 7 has a smooth continuous shape which is free of recesses and projections over its circumference area. In consequence, the arrangement provided is such that the localized concentration of the electric field does not occur on the outer surface of the cover member 7. For this reason, change in the amount of charges on respective portions of the outer surface of the cover member 7 can be held at a low level, and the amount of movement of charges is small, so that the cover member 7 is held stably in a negatively charged state.

It should be noted that an annular space having an annular cross section should preferably be formed between the cover member 7 and the housing member 6. In this case, it is possible to prevent a leak current flowing from the cover member 7 to the housing member 6 by the annular space.

Although the cover member 7 is formed by using an electrically insulating synthetic resin material similar to that of the housing member 6, the cover member 7 may be formed by using an electrically insulating synthetic resin material different from that of the housing member 6. In this case, the cover member 7 should preferably be formed of a synthetic resin material with highly insulating and non-water absorbing properties, such as PTFE (polytetrafluoroethylene), POM (polyoxymethylene), or PET (polyethylene terephthalate) with surfaces provided with water repellent treatment, so as to prevent deposition of the paint on the outer surface.

Denoted at 9 is the shaping air ring which spurts out shaping air. This shaping air ring 9 is provided on the fore end side of the housing member 6 in such a manner as to be located rearwardly of the rotary atomizing head 4. The shaping air ring 9 is formed in a tubular shape by using, for example, a conducting metallic material, and is connected to the earth through the air motor 3.

Indicated at 10 are air outlet holes which are bored in the shaping air ring 9. These air outlet holes 10 are located radially outwardly of the paint releasing edge 4A of the rotary atomizing head 4 so as to surround this paint releasing edge 4A. These air outlet holes 10 are arranged in an annular shape at fixed intervals. The air outlet holes 10 communicate with an air passage 11 provided in the housing member 6. Further, shaping air is supplied to the air outlet holes 10 through the air passage 11, and the air outlet holes 10 spurt out the shaping air toward the vicinity of the paint releasing edge 4A of the rotary atomizing head 4. As a result, the shaping air shears the liquid thread of the paint released from the rotary atomizing head 4, promotes the formation of paint particles, and shapes a spray pattern of the paint particles sprayed from the rotary atomizing head 4.

Indicated at 12 are purge air outlet holes bored in the shaping air ring 9. These purge air outlet holes 12 are provided on the inner peripheral side of the shaping air ring 9 by being located on the rear surface side of the rotary atomizing head 4. These purge air outlet holes 12 are arranged in an annular shape. The purge air outlet holes 12 communicate with the air passage 11 provided in the housing member 6. Purge air at substantially the same pressure as the shaping air is supplied to the purge air outlet holes 12 through the air passage 11, and the purge air outlet holes 12 spurt out the purge air toward the rear surface of the rotary atomizing head 4. In consequence, the purge air prevents the rear surface of the rotary atomizing head 4 from assuming a negative pressure, to thereby prevent paint from depositing on the rear surface of the rotary atomizing head 4.

Denoted at 13 is the external electrode assembly which is provided radially outwardly of the outer periphery of the housing member 6. This external electrode assembly 13 is mounted on a collar-like support member 14 disposed on the rear side of the housing member 6. The support member 14 is formed of an electrically insulating synthetic resin material similar to such as the housing member 6, and projects radially outward from the housing member 6. Meanwhile, as the external electrode assemblies 13, for example, eight acicular electrode members 13B are provided at equidistant positions in the circumferential direction by being located on the projecting end side (outer diameter side) of the support member 14. These eight acicular electrode members 13B are annularly arranged coaxially with the rotary atomizing head 4, and are disposed along a circle with the rotational shaft 3C as a center.

The external electrode assembly 13 is constituted by electrode support arms 13A each extending in the form of an elongated rod shape forwardly from the support portion 14 and the acicular electrode members 13B provided at fore distal ends of the electrode support arms 13A. Each of the electrode support arms 13A is formed in a cylindrical shape by using an electrically insulating synthetic resin material similar to such as that of the housing member 6, and its distal end is disposed radially outwardly of the outer periphery of the rotary atomizing head 4. Meanwhile, each of the acicular electrode members 13B is formed of an electrically conducting material such as a metal into a needle-like shape whose fore distal end is a free end, and is disposed in an open end of the electrode support arm 13A. Further, each acicular electrode member 13B is connected to the below-described high voltage generator 15 through a resistor 13C provided in the electrode support arm 13A.

Here, the resistor 13C suppresses the charges built up on the high voltage generator 15 side from discharging at a stretch even if the acicular electrode member 13B is short-circuited with the work piece. Further, a high voltage is arranged to be applied to the acicular electrode members 13B by the high voltage generator 15.

The above-described eight acicular electrode members 13B are annularly arranged coaxially with the rotary atomizing head 4, and are provided at positions along a large-diameter circle with a large diametrical dimension about the rotational shaft 3C which is a center. In consequence, all the eight acicular electrode members 13B have an identical distance dimension L1 with respect to the paint releasing edge 4A of the rotary atomizing head 4. The acicular electrode members 13B of the external electrode assembly 13 are spaced apart from the cover member 7 with a clearance (space) therebetween, and are arranged in such a manner as to surround the periphery of the cover member 7. In consequence, as the corona discharge occurs at the acicular electrode members 13B, the external electrode assembly 13 electrifies the paint particles being sprayed from the rotary atomizing head 4 with a negative high voltage electrostatic charge. Further, the external electrode assembly 13 supplies corona ions to the outer surface of the cover member 7 to thereby electrify the outer surface of the cover member 7.

Indicated at 15 is the high voltage generator serving as a high voltage application means mounted on, for example, the support portion 14. The high voltage generator 15 is configured by using, for instance, a multi-stage rectification circuit (so-called Cockcroft circuit). The high voltage generator 15 is connected to the acicular electrode members 13B of the external electrode assembly 13 through the resistors 13C. Further, the high voltage generator 15 generates a high voltage constituted by a DC voltage, for example, from −10 kV to −150 kV, and supplies this high voltage to the acicular electrode members 13B of the external electrode assembly 13.

Denoted at 16 is an annular projecting portion serving as an electric field concentrating portion which is provided on the fore end side of the shaping air ring 9. This annular projecting portion 16 is formed of the same conducting material as that of the shaping air ring 9, and is provided over the entire circumference of the shaping air ring 9 along the plurality of air outlet holes 10. Here, the annular projecting portion 16 is formed by subjecting a front surface of the shaping air ring 9 to cutting work or the like, and is thus formed integrally with the shaping air ring 9. The annular projecting portion 16 is formed in an annular shape along the plurality of air outlet holes 10 formed in a front side portion of the shaping air ring 9, and projects from the front side portion of the shaping air ring 9 toward the rotary atomizing head 4.

In this case, the annular projecting portion 16 has, for example, a flat fore distal end surface 16A located at its projecting end, an inclined outer peripheral surface 16B which is located on the outer peripheral side of that fore distal end surface 16A and is inclined radially outward, and a substantially annular outer peripheral edge portion 16C which is formed between the fore distal end surface 16A and the inclined outer peripheral surface 16B. Further, the air outlet holes 10 are open in the fore distal end surface 16A of the annular projecting portion 16.

It should be noted that, in the case of the first embodiment, the annular projecting portion 16 has an inclined inner peripheral surface 16D which is located on the opposite side to the inclined outer peripheral surface 16B with the air outlet holes 10 located therebetween, and which is inclined radially inward. In consequence, the annular projecting portion 16 is formed in an annular shape which is trapezoidal in cross section. However, the present invention is not limited to this particular example, and the inclined outer peripheral surface 16B and the inclined inner peripheral surface 16D of the annular projecting portion 16 need not be inclined radially. Namely, the annular projecting portion 16 may be arranged to have an outer peripheral surface and an inner peripheral surface which are, for example, parallel to the axial direction.

Further, the fore distal end of acicular electrode member 13B of the external electrode assembly 13 is located rearwardly of the open end of the air outlet hole 10. Additionally, a distance dimension L2 between the fore distal end of the annular projecting portion 16 and the fore distal end of the acicular electrode member 13B is shorter than the distance dimension L1 between the paint releasing edge 4A of the rotary atomizing head 4 and the fore distal end of the acicular electrode member 13B (L2<L1).

Furthermore, as shown in FIG. 6, a clearance dimension G between the fore distal end of the annular projecting portion 16 and the paint releasing edge 4A is set to, for example, a value of 10 to 30 mm or thereabouts. At this time, the radial spaced-apart dimension between the acicular electrode member 13B and the annular projecting portion 16 is set to a value which is, for example, 5 to 20 times or thereabouts the clearance dimension G. Although the annular projecting portion 16 is located radially outwardly of the paint releasing edge 4A, the annular projecting portion 16 and the paint releasing edge 4A are disposed at positions which are radially close to each other. For this reason, the distance dimensions L1 and L2 are set to relatively close values. In addition, the annular projecting portion 16 enhances the electric field strength at its fore distal end portion to 5 kV/mm or higher. In consequence, the annular projecting portion 16 causes the electric field to be concentrated around the air outlet holes 10 to generate the corona discharge.

The coating apparatus 1 in accordance with the first embodiment has the above-described construction, and a description will hereafter be given of the operation at the time when the coating operation is performed by using this coating apparatus 1.

The air motor 3 for constituting the atomizer 2 rotates the rotary atomizing head 4 at high speed. In this state, paint is supplied to the rotary atomizing head 4 through the feed tube 5. The atomizer 2 thereby atomizes the paint under the influence of a centrifugal force and sprays the paint as paint particles at the time when the rotary atomizing head 4 rotates. Shaping air is supplied from the shaping air ring 9, and a spray pattern constituted by the paint particles is controlled by this shaping air.

Here, a negative high voltage is applied to the acicular electrode members 13B of the external electrode assembly 13. For this reason, an electrostatic field is constantly formed between each acicular electrode member 13B and the work piece held at the earth potential. In the acicular electrode members 13B, the corona discharge occurs at their fore distal ends, so that an ionization zone due to the corona discharge is formed around the rotary atomizing head 4. As a result, the paint particles sprayed from the rotary atomizing head 4, upon passing through the ionization zone, are indirectly electrified with high voltage electrostatic charges. The paint particles which have been charged (charged paint particles) fly along the electrostatic field formed between the acicular electrode members 13B and the work piece, and deposit on the work piece.

Further, since the rotary atomizing head 4 is connected to the earth, the electric field is concentrated at the paint releasing edge 4A located on the external electrode assembly 13 side in the rotary atomizing head 4. Meanwhile, since the shaping air ring 9 is also connected to the earth, the electric field is also concentrated at the fore distal end of the annular projecting portion 16 which projects to the fore surface in the shaping air ring 9.

At this time, the distance dimension L2 between the fore distal end of the annular projecting portion 16 and the fore distal end of each acicular electrode member 13B is shorter than the distance dimension L1 between the fore distal end of the annular projecting portion 16 and the paint releasing edge 4A of the rotary atomizing head 4. For this reason, the electric field strength at the fore distal end (particularly the outer peripheral edge portion 16C) of the annular projecting portion 16 can be enhanced as compared with the paint releasing edge 4A of the rotary atomizing head 4. In consequence, a secondary corona discharge C occurs at the fore distal end portion of the annular projecting portion 16. In addition, since the distance dimensions L1 and L2 are set to relatively close values, the secondary corona discharge C also takes place at the paint releasing edge 4A.

Meanwhile, the entire outer peripheral surface 9A of the shaping air ring 9 is enshrouded by the cover member 7. In this instance, the cover member 7 is formed as a seamless, continuous tubular body, and the outer surface of the cover member 7 is free of such as recesses, projections, stepped portions, or protrusions with acutely shaped cross sections, and are provided with a smoothly continuous flat and smooth surface over its circumference area. For this reason, since the discharge does not occur at the outer peripheral surface of the cover member 7, the electric field is stabilized around the paint releasing edge 4A and the annular projecting portion 16.

Figure 4:
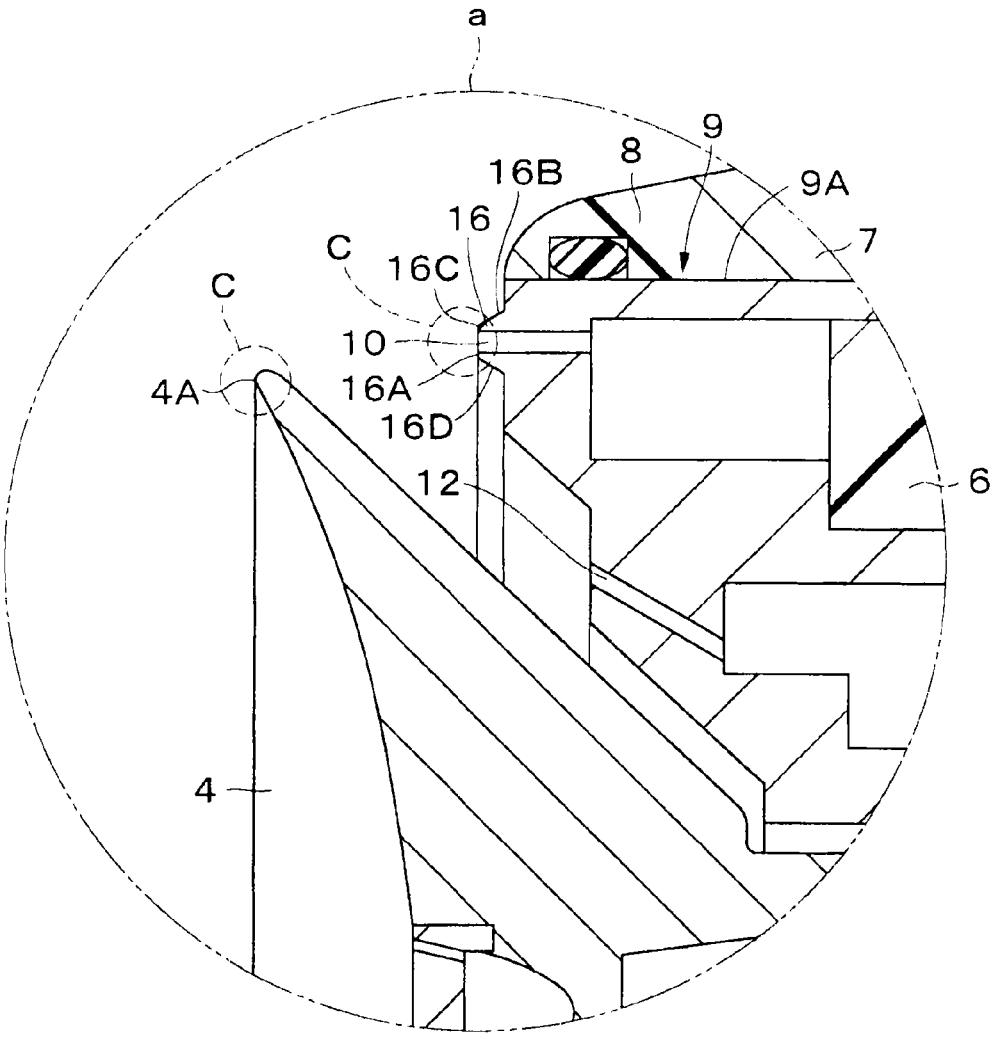
FIG. 4 is an enlarged longitudinal sectional view of an essential portion, and illustrates in enlarged form an annular projecting portion encircled at reference character a in FIG. 2.
Figure 5:
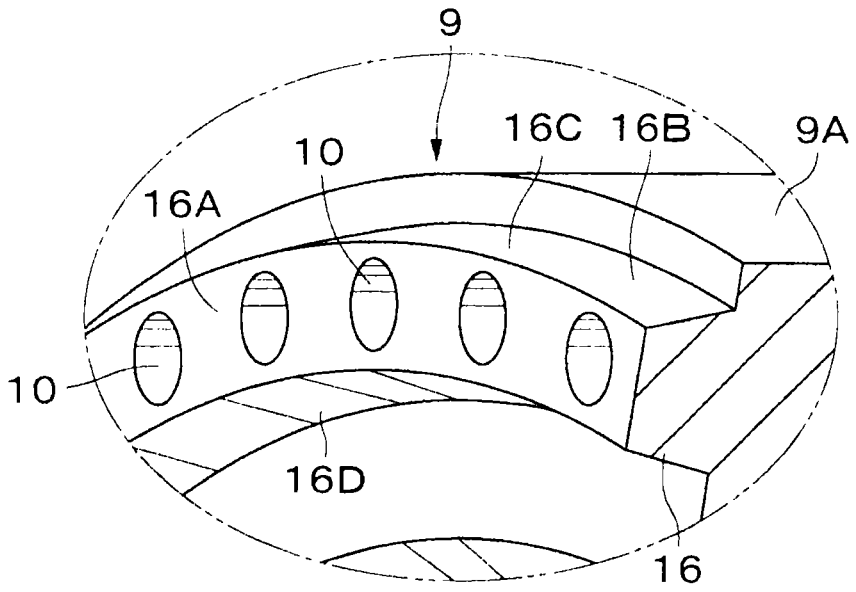
FIG. 5 is an enlarged perspective view of the essential portion, illustrating in enlarged form the annular projecting portion and the like shown in FIG. 3.

In consequence, as shown in FIG. 4, since corona discharges C can be stably generated at the annular projecting portion 16 and the paint releasing edge 4A, corona ions together with the shaping air can be supplied to the paint particles which are released from the paint releasing edge 4A. As a result, all the paint particles are reliably electrified negatively, so that electrical repulsive force is allowed to act between the paint particles and the cover member 7, thereby making it possible to reliably prevent deposition of the paint on the cover member 7. In addition, since the amount of charges in the paint particles can be increased, it is possible to augment the Coulomb force acting between the paint particles and the work piece. As a result, it is possible to enhance the deposition efficiency of the paint on the work piece.

As such, according to this embodiment, the cover member 7 is formed of an electrically insulating material, and enshrouds not only the outer peripheral side of the air motor 3 but also the outer peripheral side of the shaping air ring 9 over its circumference area. As a result, even when the shaping air ring 9 and the like are connected to the earth, discharge does not occur on the outer peripheral side of the shaping air ring 9.

Meanwhile, since the annular projecting portion 16 is formed on the shaping air ring 9, it is possible to allow the secondary corona discharge C to be generated by causing the electric field to be concentrated at the outer peripheral edge portion 16C located on the fore distal end side of the annular projecting portion 16. At this time, since the plurality of air outlet holes 10 are open at the fore distal end of the annular projecting portion 16, corona ions are generated around the air outlet holes 10. For this reason, corona ions which are generated in the vicinity of the fore distal end of the annular projecting portion 16 can be supplied toward the paint releasing edge 4A of the rotary atomizing head 4 by the shaping air which is spurted out from the air outlet holes 10.

When the liquid thread of the paint from the rotary atomizing head 4 is sheared and paint particles are sprayed, or when the paint particles are severed by the shaping air, there are cases where paint particles of opposite polarity or paint particles which lost charges are generated. Even in such a case, in this embodiment, these paint particles can be reliably electrified negatively by supplying corona ions thereto, making it possible to eliminate paint particles of opposite polarity. In consequence, since all the paint particles repel from the negatively charged cover member 7, it is possible to prevent deposition of paint on the cover member 7.

Since the annular projecting portion 16 is provided along the plurality of air outlet holes 10 over the entire circumference of the shaping air ring 9, the corona discharge C can be generated uniformly over the entire circumference of the shaping air ring 9. For this reason, when the shaping air is spurted out toward the paint releasing edge 4A of the rotary atomizing head 4, corona ions can be supplied over the entire circumference of the paint releasing edge 4A by the shaping air, so that all the paint particles sprayed from the paint releasing edge 4A can be reliably electrified negatively.

In addition, since the annular projecting portion 16 is configured to enhance the electric field strength to 5 kV/mm or higher, the electric field strength at the annular projecting portion 16 can be made higher than a minimum electric field strength which allows the corona discharge C to be generated. In consequence, the corona discharge can be maintained stably by the annular projecting portion 16.

Further, since the fore distal end of the acicular electrode member 13B is disposed at a position where the distance dimension L2 between the same and the annular projecting portion 16 is shorter than the distance dimension L1 between the same and the paint releasing edge 4A of the rotary atomizing head 4, the electric field strength at the annular projecting portion 16 can be made higher than that at the paint releasing edge 4A of the rotary atomizing head 4. Therefore, it is possible to suppress the electric field from being concentrated at the paint releasing edge 4A of the rotary atomizing head 4, so that the corona discharge C can be reliably generated by the annular projecting portion 16.

Furthermore, since the annular projecting portion 16 serving as the electric field concentrating portion is formed in an annular shape which is continuous over its entire circumference, the annular projecting portion 16 can be easily formed by, for example, cutting work or the like. For this reason, the manufacturing cost can be reduced as compared with a case where the electric field concentrating portion is formed by circumferentially discontinuous projections or the like.

Figure 7:
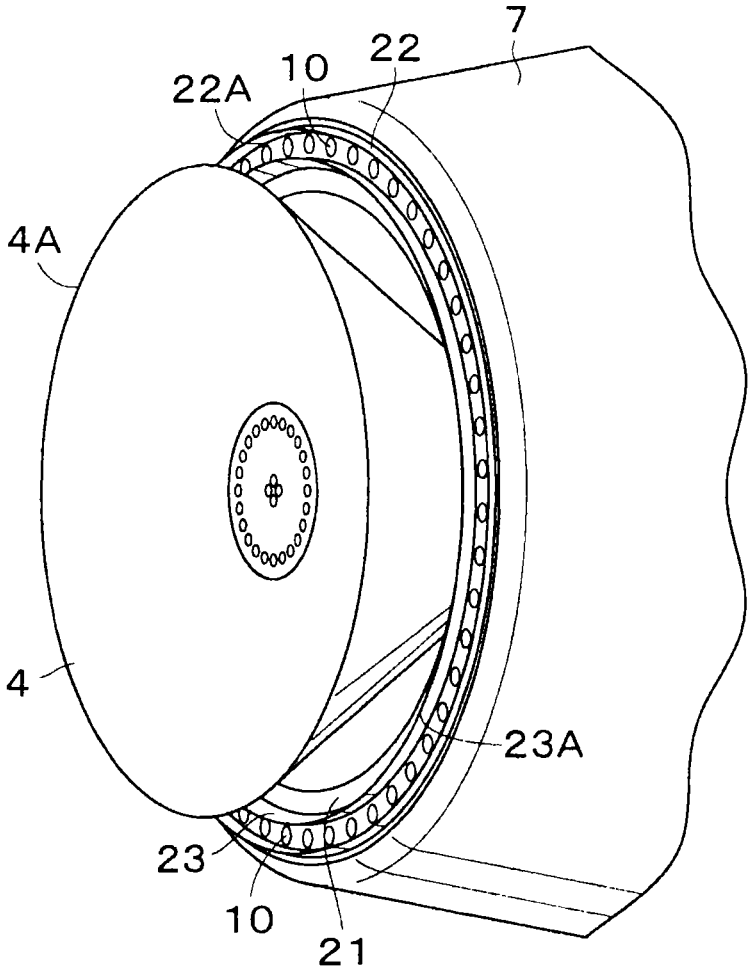
FIG. 7 is a perspective view taken from a position similar to that of FIG. 3, and illustrates in enlarged form the shaping air ring and the like in accordance with a second embodiment.
Figure 8:
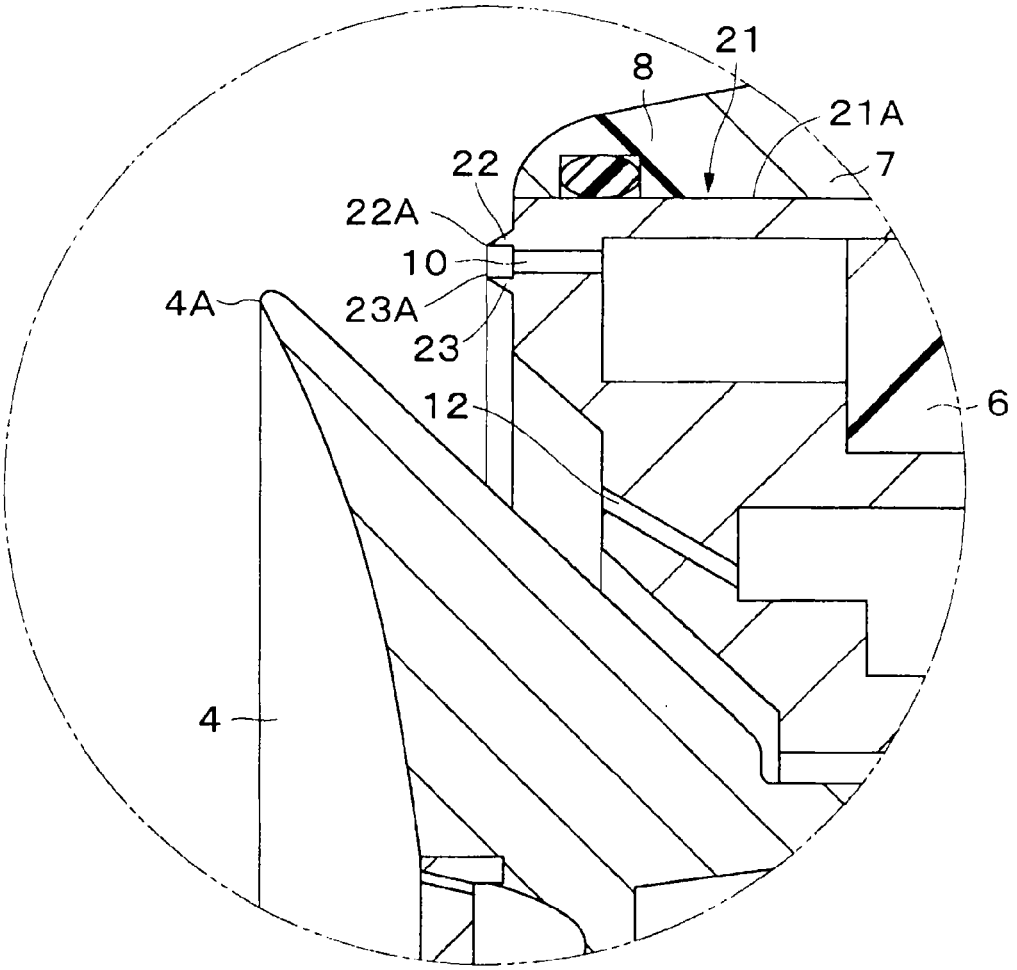
FIG. 8 is an enlarged longitudinal sectional view of the essential portion, taken from a position similar to that of FIG. 4, and illustrates in enlarged form an annular blade projecting portion shown in FIG. 7.
Figure 9:
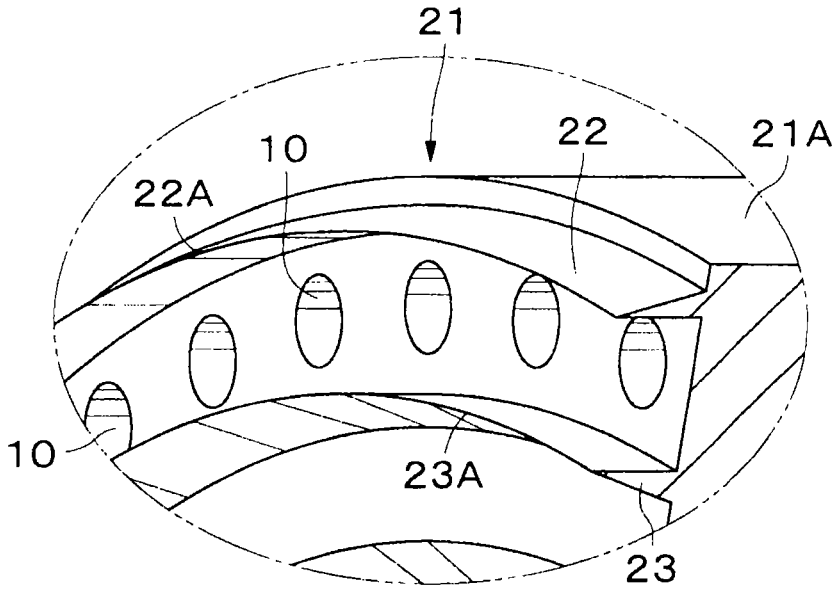
FIG. 9 is an enlarged perspective view of the essential portion, and illustrates in enlarged form the annular blade projecting portion and the like shown in FIG. 7.

Next, FIGS. 7 to 9 show a second embodiment of the electrostatic coating apparatus in accordance with the present invention.

The characteristic feature of the second embodiment lies in that an electric field concentrating portion is formed by an annular blade projecting portion which is formed in an annular shape along the plurality of air outlet holes formed in the front portion of the shaping air ring. It should be noted that, in the second embodiment, those component elements which are identical to those of the above-described first embodiment are simply designated by the same reference numerals to avoid repetitions of similar explanations.

Designated at 21 is a shaping air ring in accordance with the second embodiment. This shaping air ring 21 is constituted in substantially the same way as the shaping air ring 9 in accordance with the first embodiment. The shaping air ring 21 is formed in a tubular shape by using, for example, a conducting metallic material, and is connected to the earth through the air motor 3. An outer peripheral surface 21A of the shaping air ring 21 is enshrouded by the ring mounting portion 8 of the cover member 7. The plurality of air outlet holes 10 disposed in an annular shape so as to surround the paint releasing edge 4A of the rotary atomizing head 4 are provided in the shaping air ring 21. These air outlet holes 10 are open at positions recessed from fore distal ends of annular blade projecting portions 22 and 23 which will be described later.

It should be noted that the plurality of purge air outlet holes 12 are provided on the inner peripheral side of the shaping air ring 21 by being located on the rear surface side of the rotary atomizing head 4. The air outlet holes 10 and the purge air outlet holes 12 communicate with the air passage 11 provided in the housing member 6 in the same way as in the first embodiment.

Denoted at 22 and 23 are first and second annular blade projecting portions serving as electric field concentrating portions which are provided on the fore end side of the shaping air ring 21. The first annular blade projecting portion 22 is provided along the outer diameter side of the air outlet holes 10 over the entire circumference of the shaping air ring 21. Specifically, the first annular blade projecting portion 22 is formed in an annular shape along the plurality of air outlet holes 10 formed in the front side portion of the shaping air ring 21, and projects from the front side portion of the shaping air ring 21 toward the rotary atomizing head 4.

To describe in greater detail, the first annular blade projecting portion 22 is disposed in such a manner as to surround all the air outlet holes 10 and to be adjacent to the outer diameter side of the air outlet holes 10. The fore distal end side of the first annular blade projecting portion 22 is formed as an edge portion 22A in the form of a thin blade over an entire circumference.

Meanwhile, in the same way as the first annular blade projecting portion 22, the second annular blade projecting portion 23 is also provided over the entire circumference of the shaping air ring 21, and is formed in an annular shape along the inner diameter side of the plurality of air outlet holes 10 formed in the front side portion of the shaping air ring 21. The second annular blade projecting portion 23 projects from the front side portion of the shaping air ring 21 toward the rotary atomizing head 4. The fore distal end side of the second annular blade projecting portion 23 is formed as an edge portion 23A in the form of a thin blade over an entire circumference.

The second annular blade projecting portion 23 is disposed adjacent to the inner diameter side of the air outlet holes 10. In consequence, the first and second annular blade projecting portions 22 and 23 are located on both radial sides of the air outlet holes 10 in such a manner as to radially sandwich the air outlet holes 10.

Further, with respect to the paint releasing edge 4A of the rotary atomizing head 4 and the acicular electrode members 13B, the first and second annular blade projecting portions 22 and 23 are disposed with a positional relationship similar to that of the annular projecting portion 16 in accordance with the first embodiment. Namely, the first and second annular blade projecting portions 22 and 23 are disposed at a position closer to the fore distal ends of the acicular electrode members 13B than to the paint releasing edge 4A. The first and second annular blade projecting portions 22 and 23 enhance the electric field strength at their edge portions 22A and 23A to 5 kV/mm or higher. Therefore, the first and second annular blade projecting portions 22 and 23 cause the electric field to be concentrated around the air outlet holes 10 to generate the corona discharge on a continuous basis.

As such, with the second embodiment having the above-described construction, it is also possible to obtain operational effects substantially similar to those of the above-described first embodiment. In particular, in the second embodiment, since the electric field concentrating portions are formed by the annular blade projecting portions 22 and 23 formed in an annular shape along the plurality of air outlet holes 10 formed in the front side portion of the shaping air ring 21, the corona discharge can be generated by allowing the electric field to be concentrated at the edge portions 22A and 23A of the annular blade projecting portions 22 and 23 which are formed in fashion of thin blades.

Besides, since the plurality of air outlet holes 10 are disposed between and adjacent to the annular blade projecting portions 22 and 23, corona ions which are generated in the peripheries of the edge portions 22A and 23A of the annular blade projecting portions 22 and 23 can be supplied toward the paint releasing edge 4A of the rotary atomizing head 4 by the shaping air spurting out from the air outlet holes 10.

Figure 10:
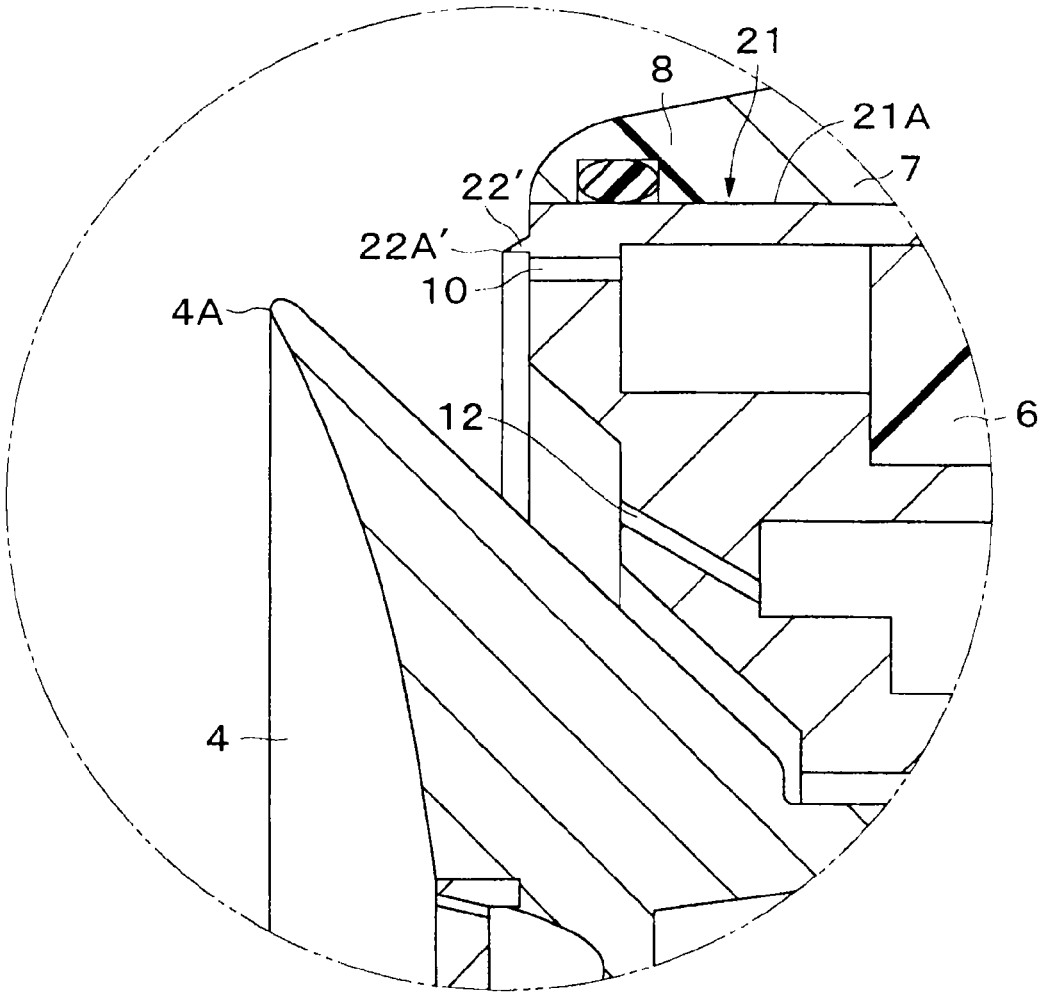
FIG. 10 is an enlarged longitudinal sectional view of the essential portion, taken from a position similar to that of FIG. 8, and illustrates in enlarged form the annular blade projecting portion in accordance with a first modification.

It should be noted that the constitution adopted in the second embodiment is such that the annular blade projecting portions 22 and 23 are provided on both the outer diameter side and the inner diameter side of the air outlet holes 10. However, the present invention is not limited to this particular example, and it is possible to adopt a constitution in which, as exemplified in a first modification shown in FIG. 10, an annular blade projecting portion 22' having an edge portion 22A' is provided only on the outer diameter side of the air outlet holes 10. Still alternatively, it is possible to adopt a constitution in which the annular blade projecting portion is provided only on the inner diameter side of the air outlet holes 10.

Figure 11:
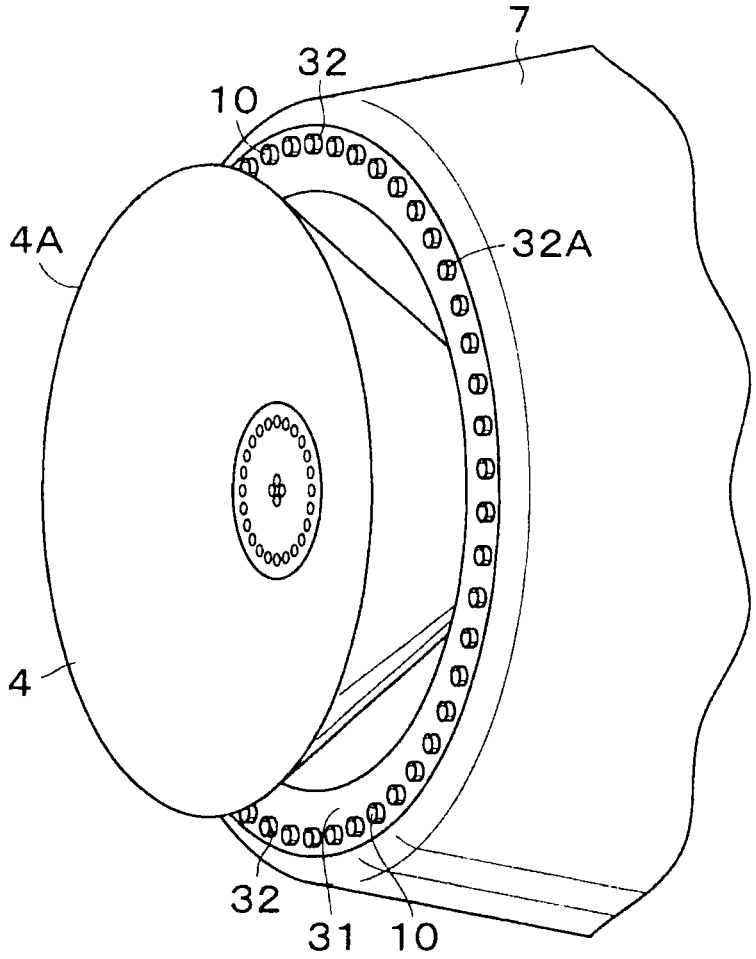
FIG. 11 is a perspective view taken from a position similar to that of FIG. 3, and illustrates in enlarged form the shaping air ring and the like in accordance with a third embodiment.
Figure 12:
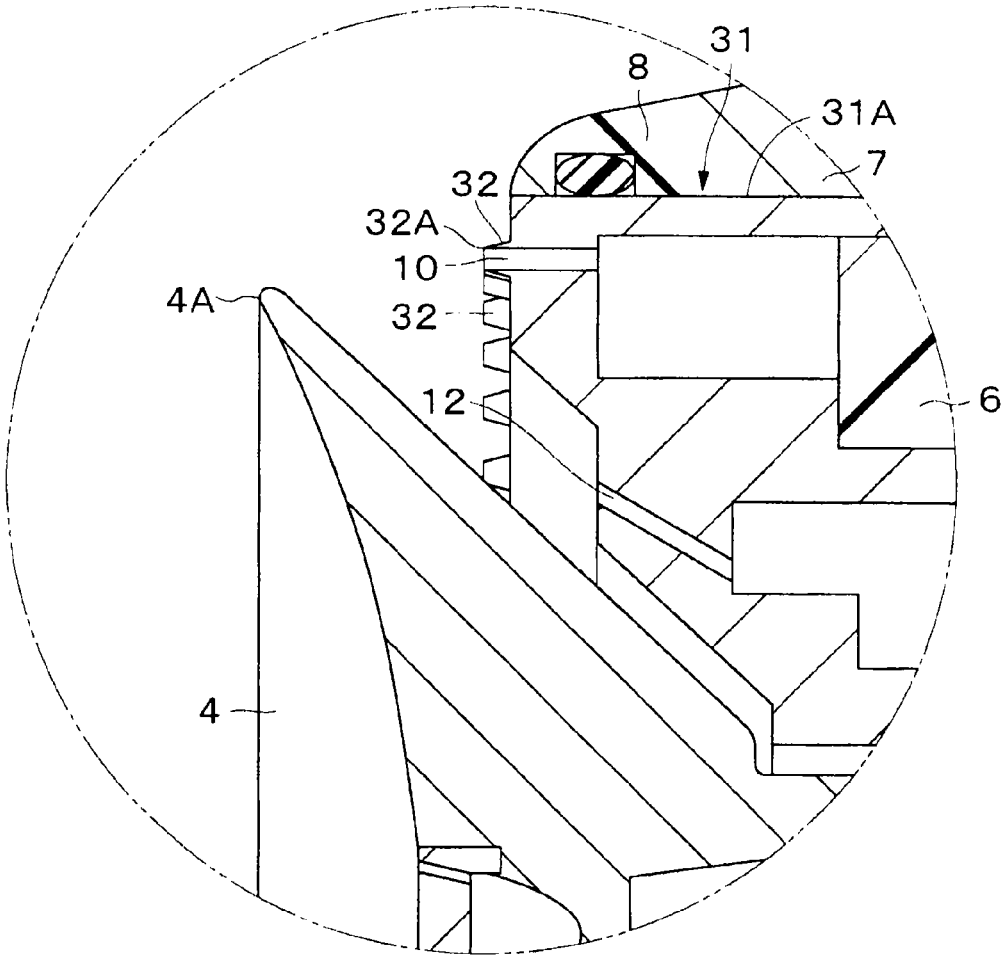
FIG. 12 is an enlarged longitudinal sectional view of the essential portion, taken from a position similar to that of FIG. 4, and illustrates in enlarged form tubular projecting portions shown in FIG. 11.
Figure 13:
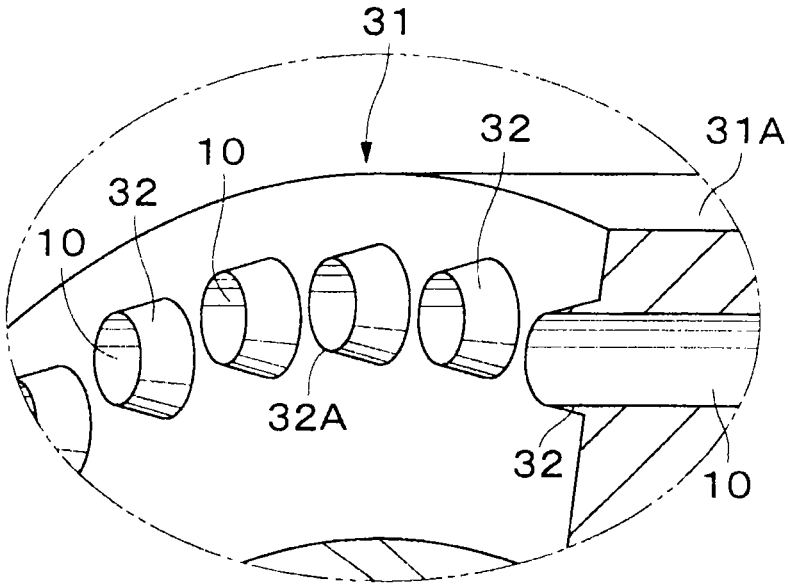
FIG. 13 is an enlarged perspective view of the essential portion, and illustrates in enlarged form the tubular projecting portions and the like shown in FIG. 11.

Next, FIGS. 11 to 13 show a third embodiment of the electrostatic coating apparatus in accordance with the present invention.

The characteristic feature of the third embodiment lies in that electric field concentrating portions are formed by a plurality of annular blade projecting portions which are provided in such a manner as to surround the open ends, respectively, of the plurality of air outlet holes formed in the front side portion of the shaping air ring. It should be noted that, in the third embodiment, those component elements which are identical to those of the above-described first embodiment are simply designated by the same reference numerals to avoid repetitions of similar explanations.

Designated at 31 is a shaping air ring in accordance with the third embodiment. This shaping air ring 31 is constituted in substantially the same way as the shaping air ring 9 in accordance with the first embodiment. The shaping air ring 31 is formed in a tubular shape by using, for example, a conducting metallic material, and is connected to the earth through the air motor 3. An outer peripheral surface 31A of the shaping air ring 31 is enshrouded by the ring mounting portion 8 of the cover member 7. The plurality of air outlet holes 10 disposed in an annular shape along the paint releasing edge 4A of the rotary atomizing head 4 are provided in the shaping air ring 31 over the entire circumference.

Denoted at 32 are tubular projecting portions serving as electric field concentrating portions which are provided on the fore end side of the shaping air ring 31. These tubular projecting portions 32 are provided over the entire circumference of the shaping air ring 31. Each of the plurality of tubular projecting portions 32 is provided in such a manner as to surround each of the open ends of the plurality of air outlet holes 10 formed in the front side portion of the shaping air ring 31. The tubular projecting portions 32 are formed in a small-diameter tubular shape by using a conducting material, and project from the front side portion of the shaping air ring 31 toward the rotary atomizing head 4.

Further, with respect to the paint releasing edge 4A of the rotary atomizing head 4 and the acicular electrode members 13B, the tubular projecting portions 32 are disposed with a positional relationship similar to that of the annular projecting portion 16 in accordance with the first embodiment. The tubular projecting portions 32 enhance the electric field strength at their fore distal ends 32A to 5 kV/mm or higher. Therefore, the tubular projecting portions 32 cause the electric field to be concentrated around the air outlet holes 10 to generate the corona discharge on a continuous basis.

As such, with the third embodiment having the above-described construction, it is also possible to obtain substantially the same operational effects as the foregoing first embodiment. In particular, in the third embodiment, since the tubular projecting portions 32 are provided in such a manner as to individually surround the open ends of the air outlet holes 10 formed in the front side portion of the shaping air ring 31, the electric field can be concentrated more easily by the circumferentially discontinuous relation as compared with the case where an electric field concentrating portion which is continuous over the entire circumference is formed. For this reason, since the corona discharge can be reliably generated at the fore distal ends 32A of the tubular projecting portions 32, when the shaping air is spurted out from the air outlet holes 10 in the tubular projecting portions 32, corona ions which are generated in the vicinities of the fore distal ends 32A of the tubular projecting portions 32 can be supplied toward the paint releasing edge 4A of the rotary atomizing head 4 by this shaping air.

Figure 14:
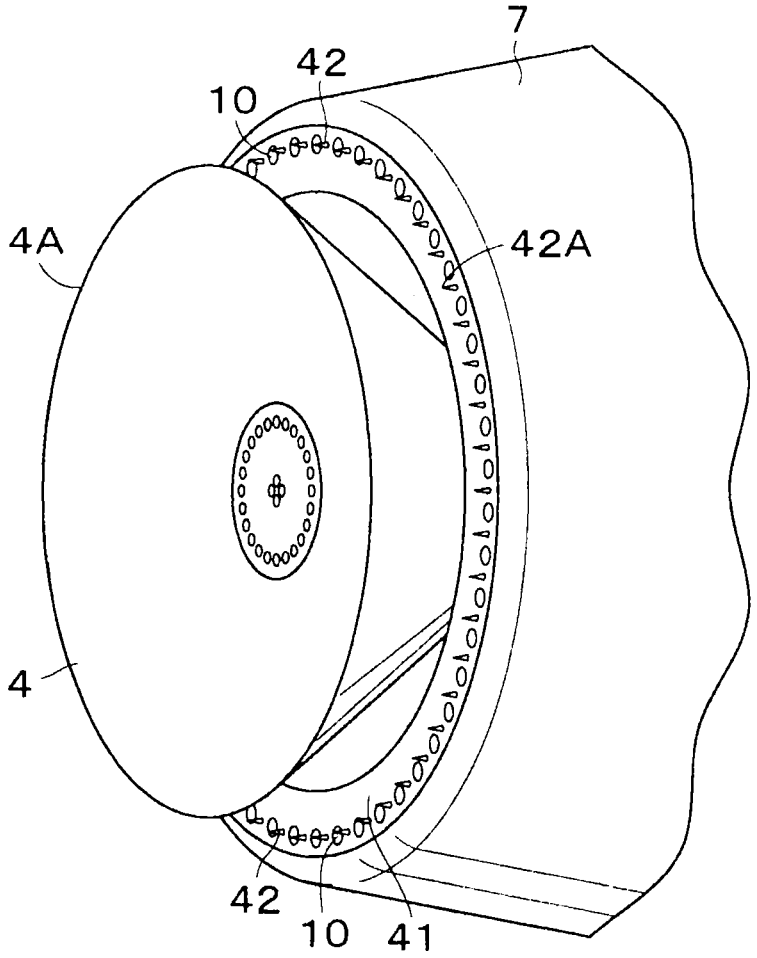
FIG. 14 is a perspective view taken from a position similar to that of FIG. 3, and illustrates in enlarged form the shaping air ring and the like in accordance with a fourth embodiment.
Figure 15:
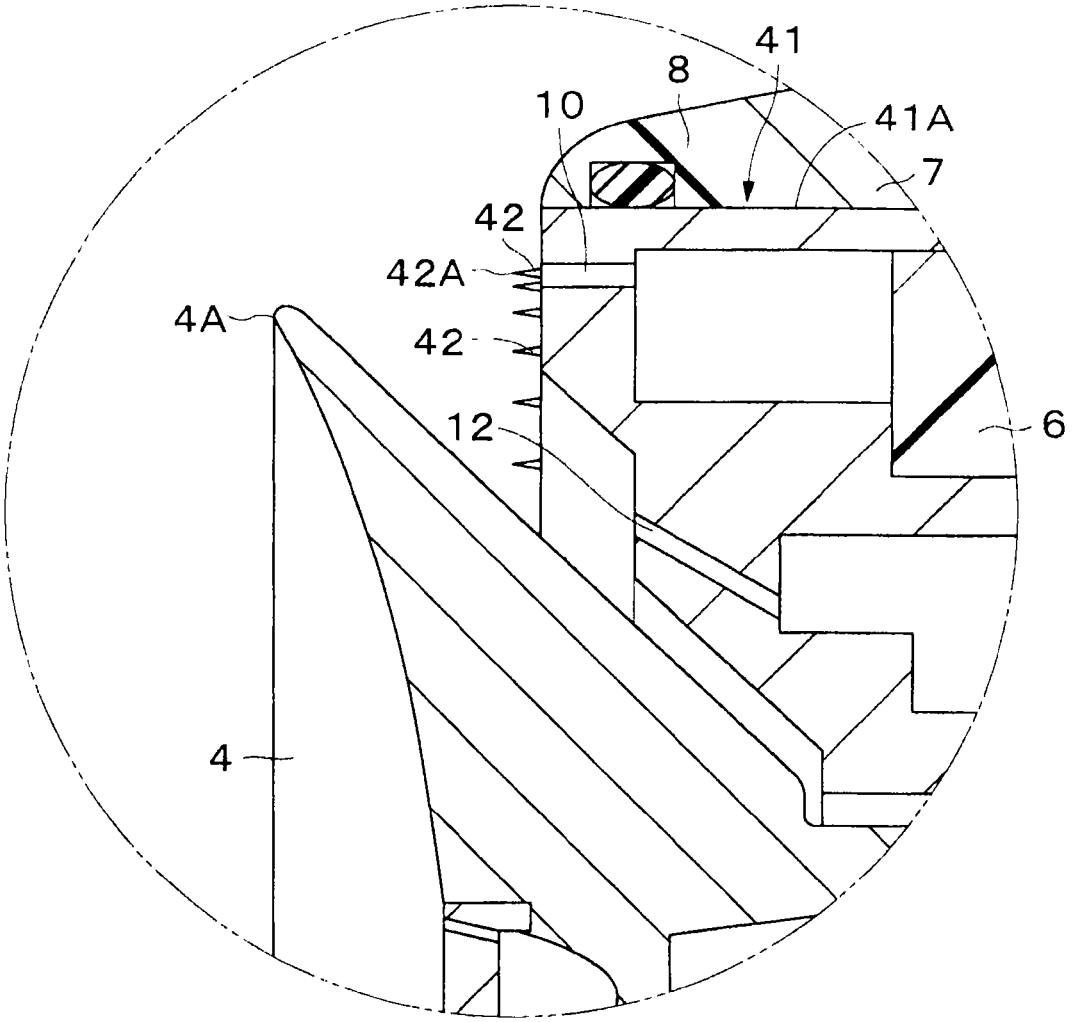
FIG. 15 is an enlarged longitudinal sectional view of the essential portion, taken from a position similar to that of FIG. 4, and illustrates in enlarged form acicular projecting portions shown in FIG. 14.
Figure 16:
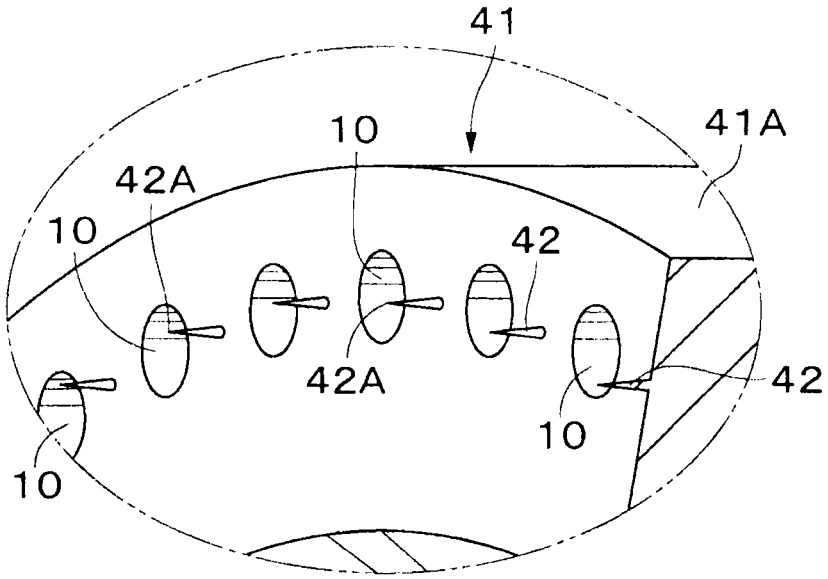
FIG. 16 is an enlarged perspective view of the essential portion, and illustrates in enlarged form the acicular projecting portions and the like shown in FIG. 14.

Next, FIGS. 14 to 16 show a fourth embodiment of the electrostatic coating apparatus in accordance with the present invention.

The characteristic feature of the fourth embodiment lies in that electric field concentrating portions are formed by a plurality of acicular projecting portions which are arranged in an annular shape along the plurality of air outlet holes formed in the front side portion of the shaping air ring. It should be noted that, in the fourth embodiment, those component elements which are identical to those of the above-described first embodiment are simply designated by the same reference numerals to avoid repetitions of similar explanations.

Designated at 41 is a shaping air ring in accordance with the fourth embodiment. This shaping air ring 41 is constituted in substantially the same way as the shaping air ring 9 in accordance with the first embodiment. The shaping air ring 41 is formed in a tubular shape by using, for example, a conducting metallic material, and is connected to the earth through the air motor 3. An outer peripheral surface 41A of the shaping air ring 41 is enshrouded by the ring mounting portion 8 of the cover member 7. The plurality of air outlet holes 10 disposed in an annular shape along the paint releasing edge 4A of the rotary atomizing head 4 are provided in the shaping air ring 41.

Denoted at 42 are acicular projecting portions serving as electric field concentrating portions which are provided on the fore end side of the shaping air ring 41. These acicular projecting portions 42 are each formed of a conducting material into a needle-like shape whose fore distal end 42A is sharpened, and these acicular projecting portions 42 are provided over the entire circumference of the shaping air ring 41. The acicular projecting portions 42 are arranged in an annular shape at fixed intervals along the plurality of air outlet holes 10 formed in the front side portion of the shaping air ring 41. Specifically, the plurality of acicular projecting portions 42 are provided between two circumferentially adjacent of the air outlet holes 10 in the shaping air ring 41. Further, the acicular projecting portions 42 project from the front side portion of the shaping air ring 41 toward the rotary atomizing head 4.

Further, with respect to the paint releasing edge 4A of the rotary atomizing head 4 and the acicular electrode members 13B, the acicular projecting portions 42 are disposed with a positional relationship similar to that of the annular projecting portion 16 in accordance with the first embodiment. The acicular projecting portions 42 enhance the electric field strength at their fore distal ends 42A to 5 kV/mm or higher. In consequence, the acicular projecting portions 42 cause the electric field to be concentrated around the air outlet holes 10 to generate the corona discharge on a continuous basis.

As such, with the fourth embodiment having the above-described construction, it is also possible to obtain substantially the same operational effects as the foregoing first embodiment. In particular, in the fourth embodiment, since the acicular projecting portions 42 are each formed into a needle-like shape whose fore distal end is sharpened, the electric field can be concentrated easily at their fore distal end portions. For this reason, since the corona discharge can be reliably generated at the fore distal ends 42A of the acicular projecting portions 42, when the shaping air is spurted out from the air outlet holes 10 arranged in vicinities to the acicular projecting portions 42, corona ions which are generated in the vicinities of the fore distal ends 42A of the acicular projecting portions 42 can be supplied toward the paint releasing edge 4A of the rotary atomizing head 4 by this shaping air.

Figure 17:
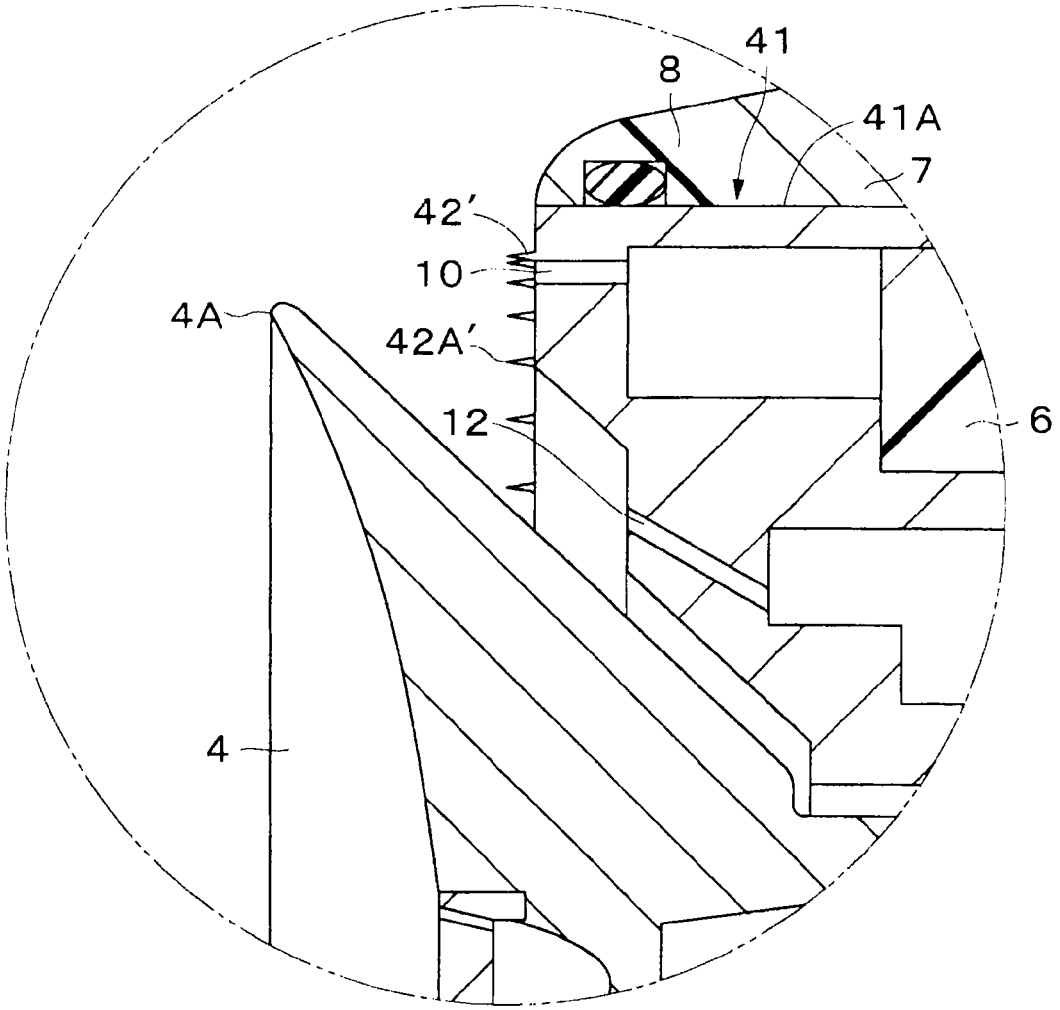
FIG. 17 is an enlarged longitudinal sectional view of the essential portion, taken from a position similar to that of FIG. 15, and illustrates in enlarged form the acicular projecting portions in accordance with a second modification.
Figure 18:
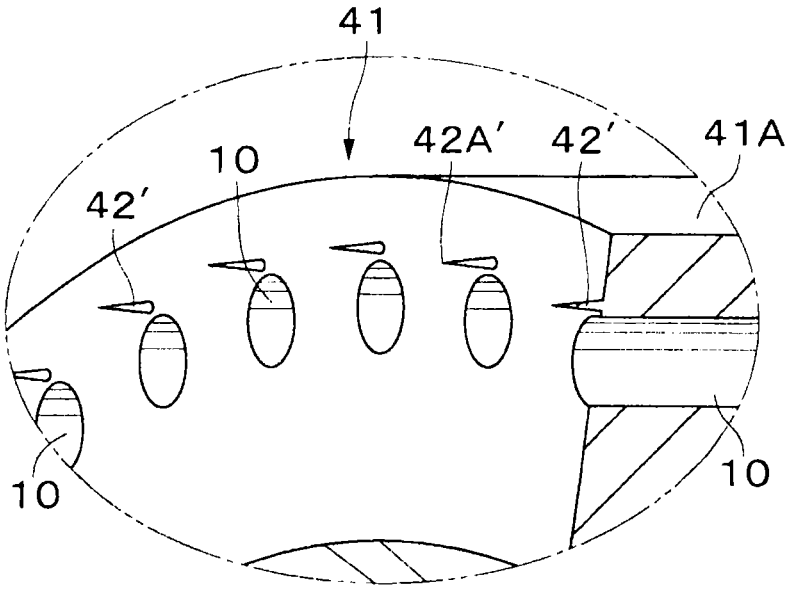
FIG. 18 is an enlarged perspective view of the essential portion, and illustrates in enlarged form the acicular projecting portions and the like in accordance with the second modification.

It should be noted that, in the constitution of the fourth embodiment, the acicular projecting portions 42 are arranged between two circumferentially adjacent of the air outlet holes 10. However, the present invention is not limited to the same, and it is possible to adopt a construction in which acicular projecting portions 42' are provided adjacently to an outer diameter side of each air outlet hole 10, as exemplified in a second modification shown in FIGS. 17 and 18. Namely, it suffices if one acicular projecting portion is disposed in a close vicinity to each air outlet hole 10.

Figure 19:
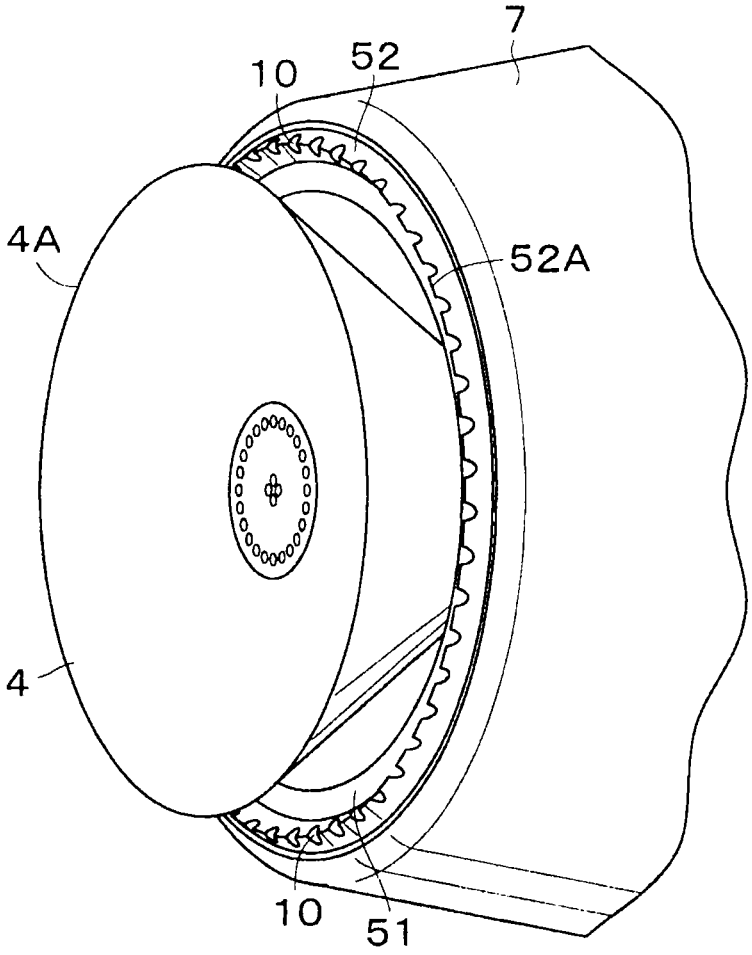
FIG. 19 is a perspective view taken from a position similar to that of FIG. 3, and illustrates in enlarged form the shaping air ring and the like in accordance with a fifth embodiment.
Figure 20:
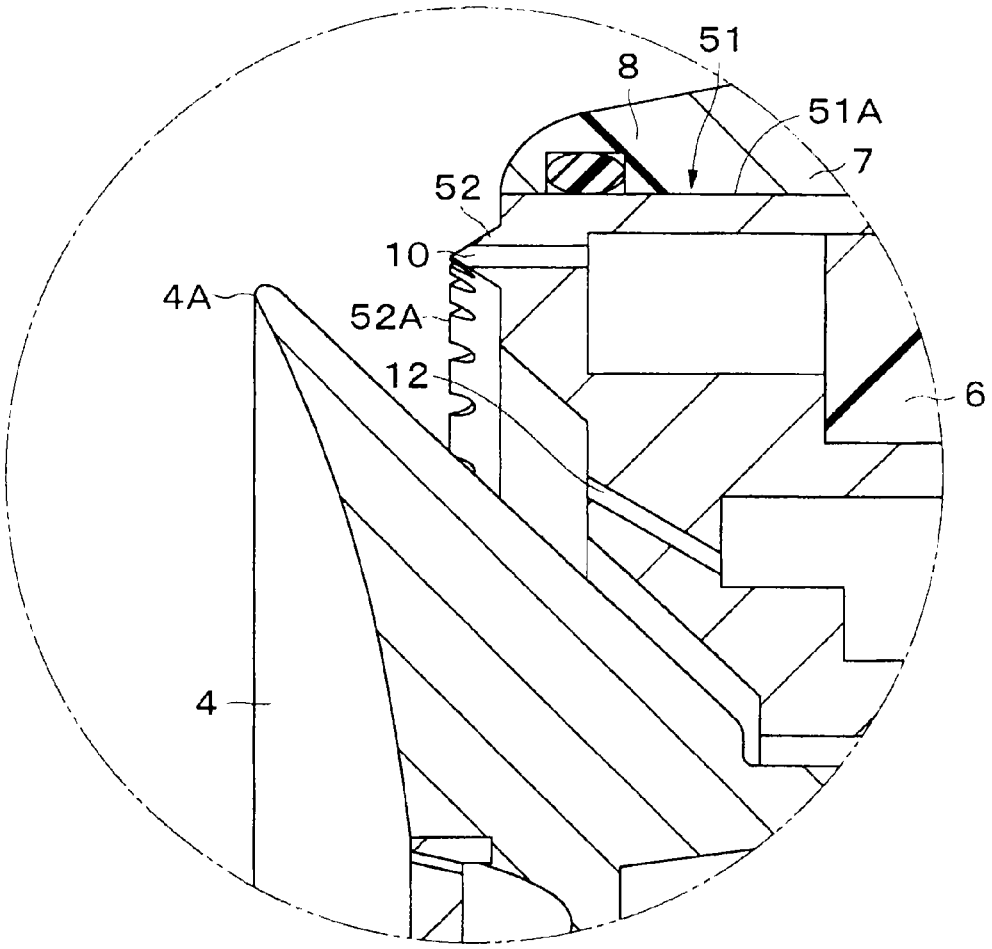
FIG. 20 is an enlarged longitudinal sectional view of the essential portion, taken from a position similar to that of FIG. 4, and illustrates in enlarged form an annular triangular projecting portion shown in FIG. 19.
Figure 21:
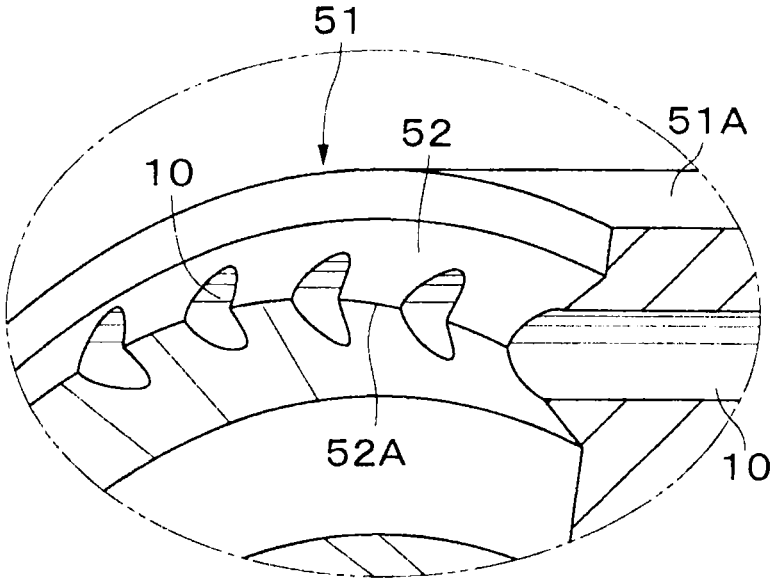
FIG. 21 is an enlarged perspective view of the essential portion, and illustrates in enlarged form the annular triangular projecting portion and the like shown in FIG. 19.

Next, FIGS. 19 to 21 show a fifth embodiment of the electrostatic coating apparatus in accordance with the present invention.

The characteristic feature of the fifth embodiment lies in that an electric field concentrating portion is formed by an annular triangular projecting portion which is formed in an annular shape along the plurality of air outlet holes formed in the front side portion of the shaping air ring, and which is triangular in cross section, the plurality of air outlet holes being open at an edge portion of the annular triangular projecting portion. It should be noted that, in the fifth embodiment, those component elements which are identical to those of the above-described first embodiment are simply designated by the same reference numerals to avoid repetitions of similar explanations.

Designated at 51 is a shaping air ring in accordance with the fifth embodiment. This shaping air ring 51 is constituted in substantially the same way as the shaping air ring 9 in accordance with the first embodiment. The shaping air ring 51 is formed in a tubular shape by using, for example, a conducting metallic material, and is connected to the earth through the air motor 3. An outer peripheral surface 51A of the shaping air ring 51 is enshrouded by the ring mounting portion 8 of the cover member 7. The plurality of air outlet holes 10 disposed in an annular shape along the paint releasing edge 4A of the rotary atomizing head 4 are provided in the shaping air ring 51.

Denoted at 52 is an annular triangular projecting portion serving as an electric field concentrating portion which is provided on the fore end side of the shaping air ring 51. The annular triangular projecting portion 52 is provided as a V-shaped projection over the entire circumference of the shaping air ring 51. Specifically, the annular triangular projecting portion 52 is formed in an annular shape along the plurality of air outlet holes 10 formed in the front side portion of the shaping air ring 51, has a triangular shape in cross section, and projects from the front side portion of the shaping air ring 51 toward the rotary atomizing head 4. Further, the fore distal end of the annular triangular projecting portion 52 is formed as a sharp edge portion 52A over the entire circumference.

Further, the plurality of air outlet holes 10 are open at fixed intervals at the edge portion 52A of the annular triangular projecting portion 52. For this reason, the plurality of air outlet holes 10 are provided at discrete positions on the edge portion 52A extending in the circumferential direction, and are arranged at equidistant positions over the entire circumference.

As such, with the fifth embodiment having the above-described construction, it is also possible to obtain substantially the same operational effects as the foregoing first embodiment. In particular, in the fifth embodiment, since the electric field concentrating portion is formed by the annular triangular projecting portion 52 formed in an annular shape along the plurality of air outlet holes 10 formed in the front side portion of the shaping air ring 51, the corona discharge can be generated by allowing the electric field to be concentrated at the edge portion 52A of the annular triangular projecting portion 52.

In the fifth embodiment, since the plurality of air outlet holes 10 are open at the edge portion 52A of the annular triangular projecting portion 52, open ends of the air outlet holes 10 can also be shaped to be acutely angled and sharp in cross section. For this reason, the corona discharge can be generated by allowing the electric field to be concentrated also at the open ends of the air outlet holes 10. Further, since the plurality of air outlet holes 10 are open at the edge portion 52A of the annular triangular projecting portion 52, corona ions which are generated in the peripheries of the edge portion 52A of the annular triangular projecting portion 52 and in the surroundings of the open ends of the air outlet holes 10 can be supplied toward the paint releasing edge 4A of the rotary atomizing head 4 by the shaping air spurting out from the air outlet holes 10.

Figure 22:
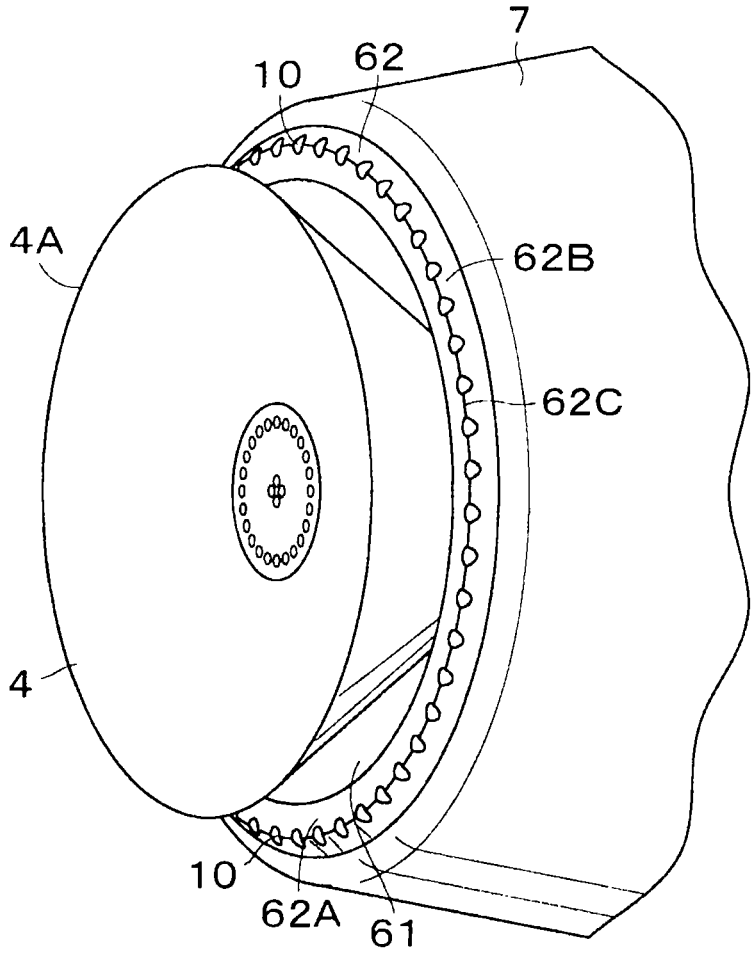
FIG. 22 is a perspective view taken from a position similar to that of FIG. 3, and illustrates in enlarged form the shaping air ring and the like in accordance with a sixth embodiment.
Figure 23:
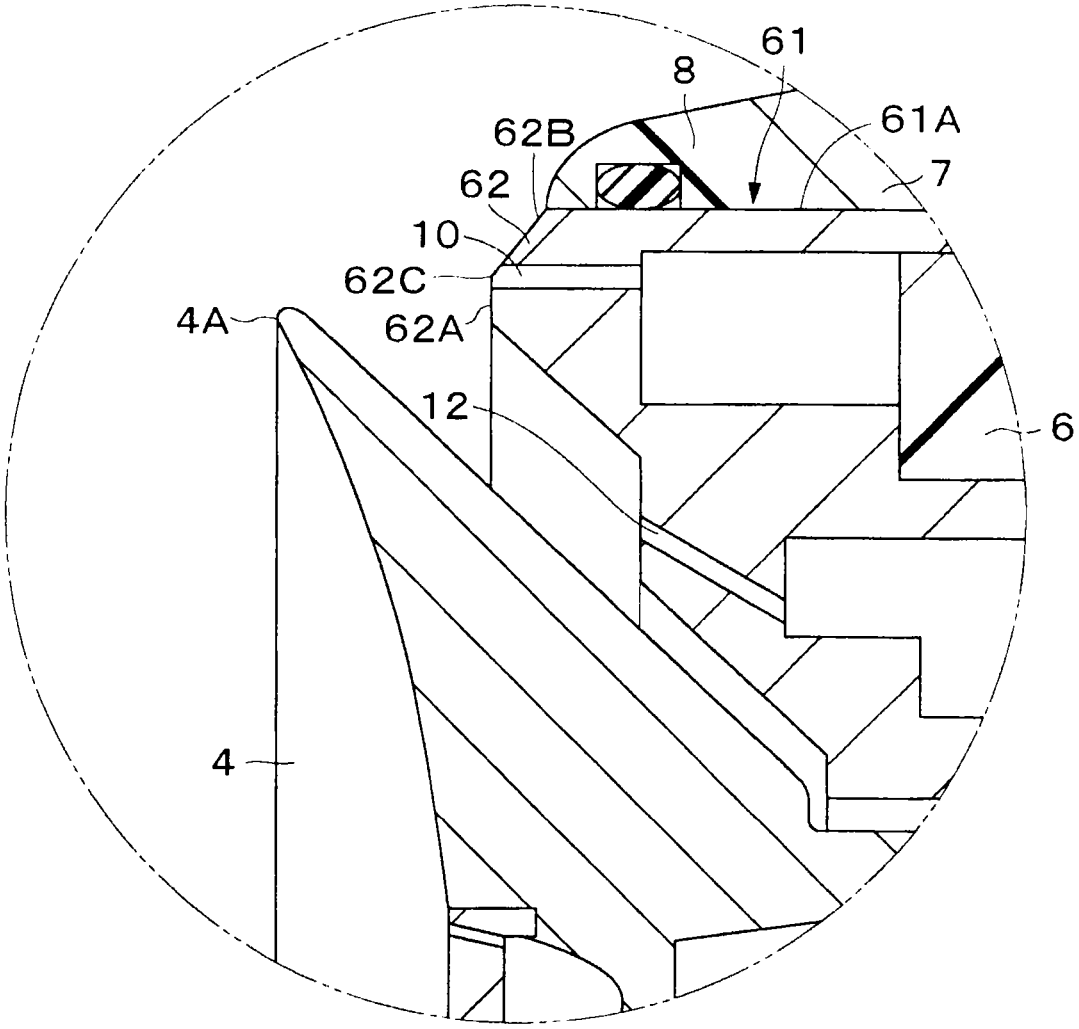
FIG. 23 is an enlarged longitudinal sectional view of the essential portion, taken from a position similar to that of FIG. 4, and illustrates in enlarged form an annular projecting portion shown in FIG. 22.
Figure 24:
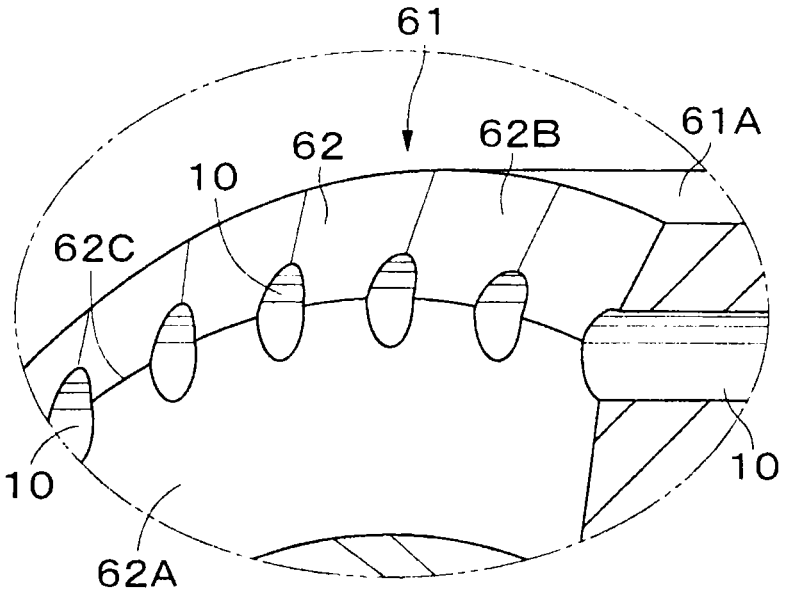
FIG. 24 is an enlarged perspective view of the essential portion, and illustrates in enlarged form the annular projecting portion and the like shown in FIG. 22.

Next, FIGS. 22 to 24 show a sixth embodiment of the electrostatic coating apparatus in accordance with the present invention.

The characteristic feature of the sixth embodiment lies in that an electric field concentrating portion is formed by an annular projecting portion which is formed in an annular shape along the plurality of air outlet holes formed in the front side portion of the shaping air ring, the plurality of air outlet holes being open at an outer peripheral edge portion of the annular projecting portion. It should be noted that, in the sixth embodiment, those component elements which are identical to those of the above-described first embodiment are simply designated by the same reference numerals to avoid repetitions of similar explanations.

Designated at 61 is a shaping air ring in accordance with the sixth embodiment. This shaping air ring 61 is constituted in substantially the same way as the shaping air ring 9 in accordance with the first embodiment. The shaping air ring 61 is formed in a tubular shape by using, for example, a conducting metallic material, and is connected to the earth through the air motor 3. An outer peripheral surface 61A of the shaping air ring 61 is enshrouded by the ring mounting portion 8 of the cover member 7. The plurality of air outlet holes 10 disposed in an annular shape along the paint releasing edge 4A of the rotary atomizing head 4 are provided in the shaping air ring 61 at fixed intervals.

Denoted at 62 is an annular projecting portion serving as an electric field concentrating portion which is provided on the fore end side of the shaping air ring 61. The annular projecting portion 62 is provided over the entire circumference of the shaping air ring 61. Specifically, the annular projecting portion 62 is formed in an annular shape along the plurality of air outlet holes 10 formed in the front side portion of the shaping air ring 61, has a trapezoidal shape in cross section, and projects from the front side portion of the shaping air ring 61 toward the rotary atomizing head 4.

The annular projecting portion 62 has, for example, a flat fore distal end surface 62A located at its projecting end, an inclined outer peripheral surface 62B which is located on the outer peripheral side of that fore distal end surface 62A and is inclined radially outward, and an annular outer peripheral edge portion 62C which is formed between the fore distal end surface 62A and the inclined outer peripheral surface 62B. Further, the inner peripheral surface of the annular projecting portion 62 is continuous to the inner peripheral surface of the tubular shaping air ring 61.

Further, the plurality of air outlet holes 10 are open at the outer peripheral edge portion 62C of the annular projecting portion 62. For this reason, the plurality of air outlet holes 10 are provided at a boundary position of the outer peripheral edge portion 62C extending in the circumferential direction, and are arranged at equidistant positions over the entire circumference.

As such, with the sixth embodiment having the above-described construction, it is also possible to obtain substantially the same operational effects as the foregoing first embodiment. In particular, in the sixth embodiment, since the electric field concentrating portion is formed by the annular projecting portion 62 formed in an annular shape along the plurality of air outlet holes 10 formed in the front side portion of the shaping air ring 61, the corona discharge can be generated by allowing the electric field to be concentrated at the outer peripheral edge portion 62C of the annular projecting portion 62. Additionally, since the plurality of air outlet holes 10 are open at the outer peripheral edge portion 62C of the annular projecting portion 62, corona ions which are generated in the outer peripheral edge portion 62C of the annular projecting portion 62 can be supplied toward the paint releasing edge 4A of the rotary atomizing head 4 by the shaping air spurting out from the air outlet holes 10.

Figure 25:
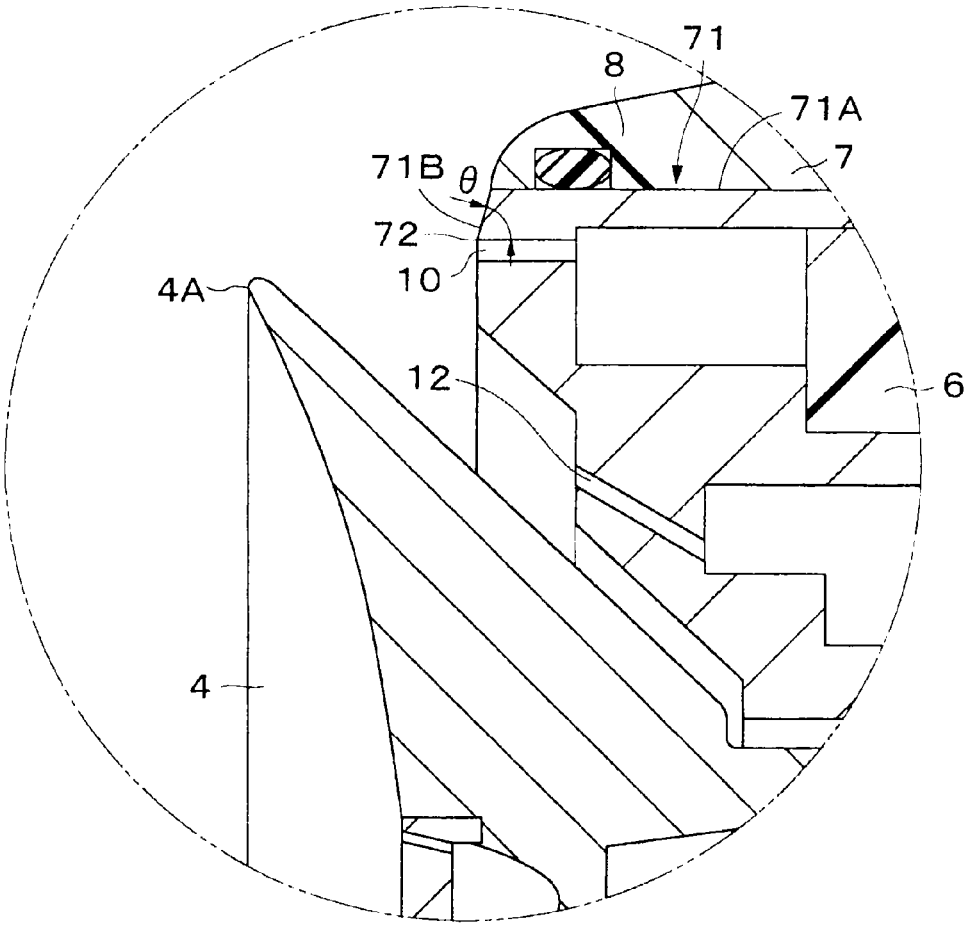
FIG. 25 is an enlarged longitudinal sectional view taken from a position similar to that of FIG. 4, and illustrates in enlarged form acute angle opening portions in accordance with a seventh embodiment.
Figure 26:
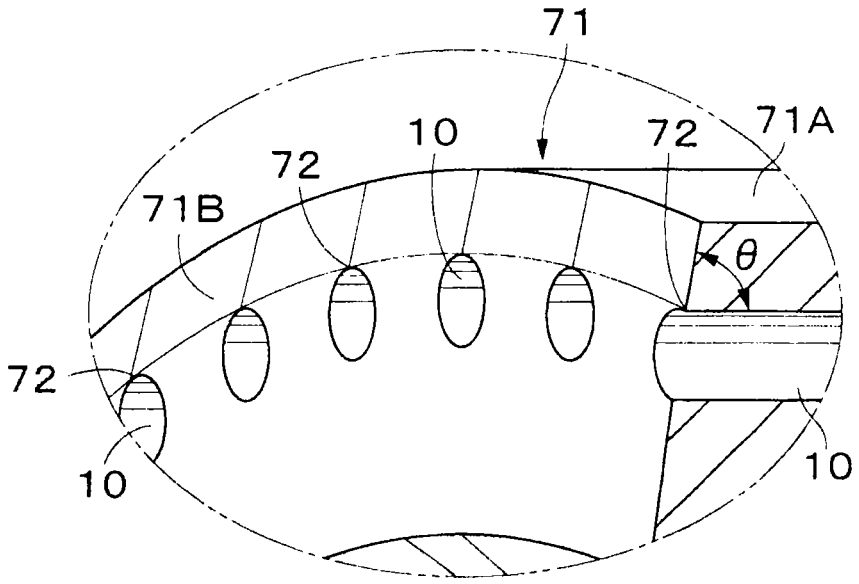
FIG. 26 is an enlarged perspective view of the essential portion, and illustrates in enlarged form the acute angle opening portions and the like in accordance with the seventh embodiment.

Next, FIGS. 25 and 26 show a seventh embodiment of the electrostatic coating apparatus in accordance with the present invention.

The characteristic feature of the seventh embodiment lies in that electric field concentrating portions are formed by a plurality of acute angle opening portions which are formed at respective open ends of the plurality of air outlet holes formed in the front side portion of the shaping air ring, and that the cross section of the opening of each air outlet hole is formed at an acute angle. It should be noted that, in the seventh embodiment, those component elements which are identical to those of the above-described first embodiment are simply designated by the same reference numerals to avoid repetitions of similar explanations.

Designated at 71 is a shaping air ring in accordance with the seventh embodiment. This shaping air ring 71 is constituted in substantially the same way as the shaping air ring 9 in accordance with the first embodiment. The shaping air ring 71 is formed in a tubular shape by using, for example, a conducting metallic material, and is connected to the earth through the air motor 3. An outer peripheral surface 71A of the shaping air ring 71 is enshrouded by the ring mounting portion 8 of the cover member 7. The plurality of air outlet holes 10 disposed in an annular shape along the paint releasing edge 4A of the rotary atomizing head 4 are provided in the shaping air ring 71 at fixed intervals.

Denoted at 72 are acute angle opening portions serving as electric field concentrating portions which are provided on the fore end side of the shaping air ring 71. The acute angle opening portions 72 are provided at respective open ends of the plurality of air outlet holes 10, and are formed by forming the angle θ of the cross section of the opening of each air outlet hole 10 into an acute angle. Here, a chamfered portion 71B is formed on the outer peripheral side of the front surface of the shaping air ring 71. Meanwhile, the air outlet holes 10 extend in the axial direction. In this case, each acute angle opening portion 72 is located on the outer peripheral side in the open end of the air outlet hole 10, and the angle θ of its cross section is set as an acute angle smaller than 90°.

With respect to the paint releasing edge 4A of the rotary atomizing head 4 and the acicular electrode members 13B, each acute angle opening portion 72 is disposed with a positional relationship similar to that of the annular projecting portion 16 in accordance with the first embodiment. The acute angle opening portions 72 enhance the electric field strength at their fore distal ends to 5 kV/mm or higher. In consequence, the acute angle opening portions 72 cause the electric field to be concentrated around the air outlet holes 10 to generate the corona discharge on a continuous basis.

As such, with the seventh embodiment having the above-described construction, it is also possible to obtain substantially the same operational effects as the foregoing first embodiment. In particular, in the seventh embodiment, since the acute angle opening portions 72 are formed into an acute angle of the cross section of the opening of the air outlet hole 10, the corona discharge can be generated by causing the electric field to be concentrated at the acute angle opening portions 72. Further, since the acute angle opening portions 72 are formed at the open ends of the air outlet holes 10, corona ions which are generated in the vicinities of fore distal ends of the acute angle opening portions 72 can be supplied toward the paint releasing edge 4A of the rotary atomizing head 4 by the shaping air spurting out from the air outlet holes 10.

Figure 27:
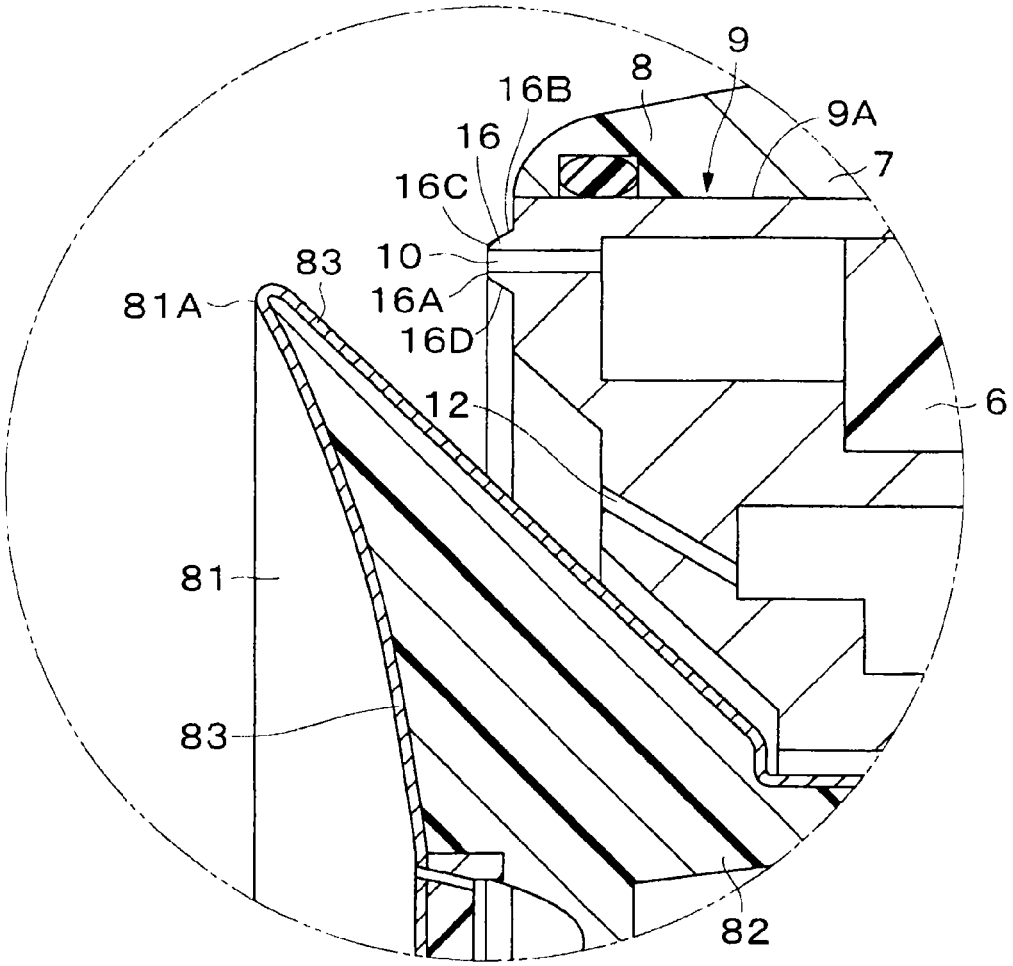
FIG. 27 is an enlarged longitudinal sectional view of the essential portion, taken from a position similar to that of FIG. 4, and illustrates in enlarged form the rotary atomizing head in accordance with a third modification.

It should be noted that, in the foregoing embodiments, the rotary atomizing head 4 in its entirety is formed of a conducting material. However, the present invention is not limited to this particular example, and it is possible to adopt a configuration in which, as exemplified in a third modification shown in FIG. 27, a rotary atomizing head 81 is used which is provided with an electrically conducting or semi-conducting film 83 on the outer surface and the inner surface of a main body portion 82 formed of an electrically insulating material. In this case, a paint releasing edge 81A of the rotary atomizing head 81 is connected to the earth through the film 83.

Further, in the foregoing embodiments, the external electrode assembly 13 is formed by using the acicular electrode members 13B. However, the present invention is not limited to this particular example, and the external electrode assembly may be formed by using, for example, a ring electrode obtained by forming an elongated conductive wire in an annular shape in such a manner as to surround the outer peripheral side of the cover member. Still alternatively, the external electrode assembly may be formed by using such as a blade ring formed in the fashion of a thin blade, a star ring obtained by forming an elongated conductive wire into a star shape, or a helical ring formed by helically winding a conductive wire into a helical coil shape, as disclosed in International Publication No. WO2007/015336.

In addition, although the configuration provided in the foregoing embodiments is such that the housing member 6 and the cover member 7 are provided separately, the housing member and the cover member may be formed integrally by using an electrically insulating material.

Furthermore, in the foregoing embodiments, the shaping air rings 9, 21, 31, 41, 51, 61, and 71 are constructed such that the plurality of air outlet holes 10 for spurting out shaping air are arranged in a single annular shape at equidistant positions from the rotational shaft 3C. However, the present invention is not limited to this particular example, and the air outlet holes may be arranged in a double annular shape, for instance. In this case, the electric field concentrating portions may be disposed in the surroundings of all the air outlet holes. Meanwhile, the electric field concentrating portions may be arranged to be disposed in the surroundings of only one side, namely, the inner diameter side or the outer diameter side, of the air outlet holes arranged in the double annular shape.

DESCRIPTION OF REFERENCE NUMERALS

1: Rotary atomizing head coating apparatus
3: Air motor (Motor)
4, 81: Rotary atomizing head
4A, 81A: Paint releasing edge
7: Cover member
9, 21, 31, 41, 51, 61, 71: Shaping air ring
9A, 21A, 31A, 41A, 51A, 61A, 71A: Outer peripheral surface
10: Air outlet hole
13: External electrode assembly
15: High voltage generator (High voltage application means)
16, 62: Annular projecting portion (Electric field concentrating portion)
16A, 62A: Fore distal end surface
16B, 62B: Inclined outer peripheral surface
16C, 62C: Outer peripheral edge portion
22, 23, 22': Annular blade projecting portion (Electric field concentrating portion)
22A, 23A, 22A', 52A: Edge portion
32: Tubular projecting portion (Electric field concentrating portion)
42, 42': Acicular projecting portion (Electric field concentrating portion)
52: Annular triangular projecting portion (Electric field concentrating portion)
72: Acute angle opening portion (Electric field concentrating portion)

The invention claimed is:

1. An electrostatic coating apparatus comprising:

a motor, a rotary atomizing head provided rotatably on a fore end side of said motor, a shaping air ring disposed on a rear side of said rotary atomizing head, a plurality of air outlet holes provided in said shaping air ring and arranged in an annular shape along a paint releasing edge of said rotary atomizing head to spurt out shaping air, a cover member provided in a tubular shape in such a manner as to enshroud outer surfaces of said motor, an external electrode assembly provided on an outer periphery of said cover member, and a high voltage generator to apply high voltage to said external electrode assembly to indirectly electrify sprayed paint particles from said rotary atomizing head with a high voltage electrostatic charge, wherein:

said rotary atomizing head is formed of a material which is electrically conductive in its entirety or whose surface at least is electrically conductive or semi-conductive and said rotary atomizing head is connected to the earth;

said shaping air ring is formed of an electrically conducting material, and is connected to the earth;

said cover member is formed of an electrically insulating material, and is arranged to enshroud an outer peripheral side of said shaping air ring over its entire surface;

an electric field concentrating portion for causing an electric field to be concentrated around said air outlet holes is provided on said shaping air ring;

said electric field concentrating portion is formed by an annular triangular projecting portion which is formed in an annular shape along said plurality of air outlet holes formed in a front side portion of said shaping air ring;

said annular triangular projecting portion has a triangular shape in cross section, and projects from the front side portion of said shaping air ring toward said rotary atomizing head, and a fore distal end thereof is formed as a sharp edge portion over an entire circumference, and said plurality of air outlet holes are arranged to be open at said edge portion of said annular triangular projecting portion.

2. An electrostatic coating apparatus as defined in claim 1, wherein said electric field concentrating portion is arranged to be provided over an entire circumference of said shaping air ring along said plurality of air outlet holes.

3. An electrostatic coating apparatus as defined in claim 1, wherein said electric field concentrating portion is adapted to enhance the electric field strength to 5 kV/mm or higher.

4. An electrostatic coating apparatus as defined in claim 1, wherein a fore distal end of said external electrode assembly is disposed rearwardly of said air outlet holes, and A distance dimension between the fore distal end of said external electrode assembly and said electric field concentrating portion is arranged to be set to a value shorter than a distance dimension between the fore distal end of said external electrode assembly and said paint releasing edge of said rotary atomizing head.

* * * * *